US007364135B2

(12) United States Patent
Gerrety et al.

(10) Patent No.: US 7,364,135 B2
(45) Date of Patent: Apr. 29, 2008

(54) PANEL ASSEMBLY SYSTEM

(76) Inventors: Timothy M. Gerrety, 900 E. Elm, #16, Redwood Falls, MN (US) 56283; Michael A. Gerrety, 23175 295th St., Seaforth, MN (US) 56287

( * ) Notice: Subject to any disclaimer, the term of this patent is extended or adjusted under 35 U.S.C. 154(b) by 0 days.

(21) Appl. No.: 11/498,322

(22) Filed: Aug. 1, 2006

(65) Prior Publication Data

US 2007/0033791 A1 Feb. 15, 2007

Related U.S. Application Data

(60) Provisional application No. 60/776,564, filed on Feb. 24, 2006, provisional application No. 60/704,596, filed on Aug. 2, 2005.

(51) Int. Cl.
*B25B 25/00* (2006.01)

(52) U.S. Cl. ..... 254/209

(58) Field of Classification Search ..... 254/199, 254/209, 243, 244, 334, 217, 218
See application file for complete search history.

(56) References Cited

U.S. PATENT DOCUMENTS 4,235,420 A * 11/1980 Ross et al. ..... 254/218
4,742,992 A * 5/1988 Allen ..... 254/199
4,795,136 A * 1/1989 Haefner ..... 254/336
6,508,456 B2 * 1/2003 Hulburd et al. ..... 254/218
6,988,713 B2 * 1/2006 Walls ..... 254/218
7,032,886 B1 * 4/2006 Kraft ..... 254/200
7,070,169 B2 * 7/2006 Hernandez, Jr. ..... 254/243
2004/0169170 A1 * 9/2004 Hernandez, Jr. ..... 254/243

OTHER PUBLICATIONS

"Structural Insulated Panels", Rural Builder, Dec. 2005, ISSN: 0888-3025.

Michael Morley, *Building With Structural Insulated Panels* (*SIPS*), chapters 6 and 7, "Standing the Walls", "Installing the Roof", pp. 103-139; Taunton Press, 2000, ISBN 1-56158-351-0.

* cited by examiner

*Primary Examiner*—Emmanuel M Marcelo
(74) *Attorney, Agent, or Firm*—Westman, Champlin & Kelly, P.A.

(57) ABSTRACT

A panel assembly system is disclosed, which includes an anchor; a tension line, secured to the anchor; and a puller, comprising an engaging face, a pivot joint secured to the engaging face, a lever rotatably mounted about the pivot joint, and a roller mounted on the lever, wherein the puller is configured to receive the tension line threaded about the puller and the pin, and to self-bind the tension line at the puller and tense the tension line between the puller and the anchor, when the lever is rotated.

20 Claims, 24 Drawing Sheets

FIG. 4
PRIOR ART
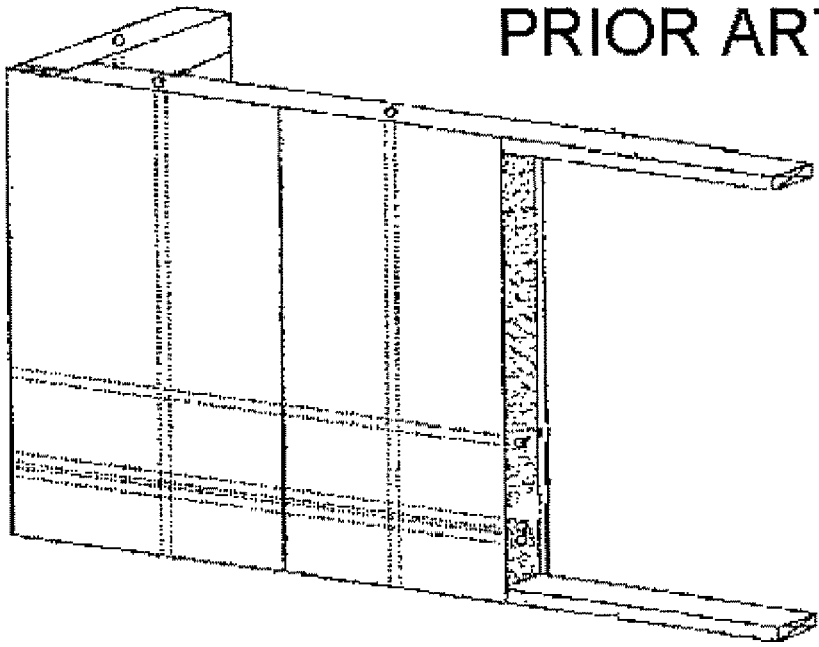
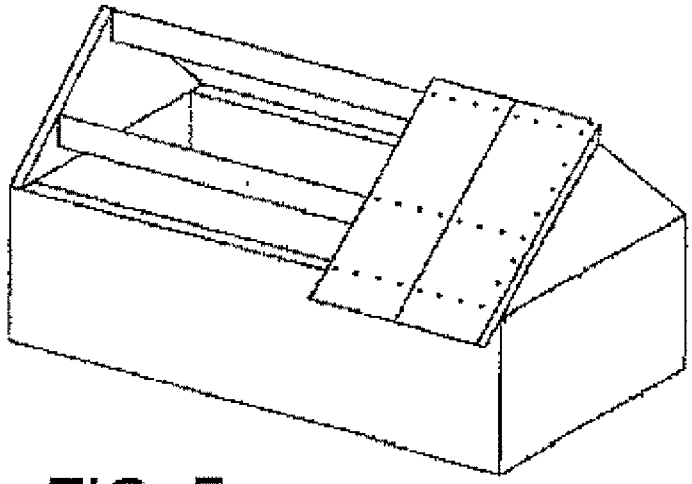
FIG. 5
PRIOR ART

PANEL ASSEMBLY SYSTEM

CROSS-REFERENCE TO RELATED APPLICATIONS

This application claims the benefit of U.S. Provisional Application Ser. No. 60/704,596, entitled "PANEL PULLER SYSTEM", filed Aug. 2, 2005, and of U.S. Provisional Application Ser. No. 60/776,564, entitled "PANEL PULLER SYSTEM", filed Feb. 24, 2006, both of which are incorporated by reference herein.

FIELD OF THE INVENTION

The present invention relates to construction tools, and particularly to a panel assembly system for pulling panels together into a tight fit.

The present invention relates to floor, roof, basement, wall panel, or modular construction and installation. It is in the installation of these panels that there is a need for leveraging these panels into place without damaging them. Embodiments of the present invention include a panel puller used to pull these panels into place.

BACKGROUND

Panels are manufactured through out the United States by numerous companies. One style of panel system is known as Structured Insulated Panels (SIPs). A SIP consists of a core of expanded polystyrene (EPS) glued between two sheets of oriented strand board (OSB) or plywood. These panels come in 4×8 to 8×28 foot sheets that are either lifted by one or more people or are craned into approximate position. They can be very heavy, bulky and difficult to move into their final place. Once they are in approximate position they are typically pried and moved into place using crow bars, sledge hammers, ratchet strap tie downs, and/or come-a-longs. This typically results in minor to major damage to the sides and ends of the panels. In addition to damaging the sides of the panels, the come-a-longs, ratchet straps and other traditional tools can be very time consuming and frustrating to work with, offer limited leverage, and take additional personnel to perform the given task of panel installation.

A need has therefore been felt to simplify the operation of installing panels.

The discussion above is merely provided for general background information and is not intended to be used as an aid in determining the scope of the claimed subject matter.

SUMMARY

The present invention pertains to a panel puller system that provides a simpler and more efficient system for pulling panels tightly together, according to one illustrative embodiment. The panel puller system includes an anchor; a tension line, secured to the anchor; and a puller, comprising an engaging face, a pivot joint secured to the engaging face, a lever rotatably mounted about the pivot joint, and a roller or rollers mounted on the lever, wherein the puller is configured to receive the tension line threaded about the puller and the pivot joint, and to self-bind the tension line at the puller and tense the tension line between the puller and the anchor, when the lever is rotated.

The Summary and Abstract are provided to introduce a selection of concepts in a simplified form that are further described below in the Detailed Description. The Summary and Abstract are not intended to identify key features or essential features of the claimed subject matter, nor is it intended to be used as an aid in determining the scope of the claimed subject matter. The claimed subject matter is not limited to implementations that solve any or all disadvantages noted in the background. Various embodiments provide a wealth of additional and unexpected advantages, beyond the resolution of difficulties with current solutions. A variety of other variations and embodiments besides those illustrative examples specifically discussed herein are also contemplated, and may be discerned by those skilled in the art from the entirety of the present disclosure.

BRIEF DESCRIPTION OF THE DRAWINGS

FIG. 4 depicts prior art wall panels, to provide context for the panel puller system.

FIG. 5 depicts prior art roof panels, to provide context for the panel puller system.

DETAILED DESCRIPTION OF ILLUSTRATIVE EMBODIMENTS

Figure 1:
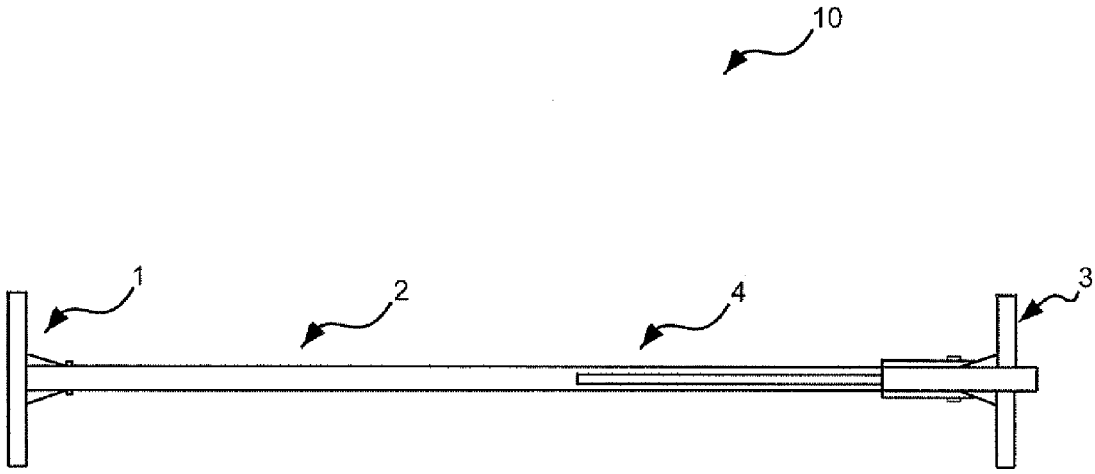
FIG. 1 depicts a top view of a panel puller system according to one illustrative embodiment.

Aspects of a panel assembly system, i.e. a panel puller system, according to a variety of embodiments not only simplify the operation of installing panels, they are more efficient and expedient than traditional tools and methods as well. The panel puller may be used in the installation of wall panels, floor panels, basement panels, ceiling panels, and roof panels, for example. Referring for example to FIG. 1 and the illustrative embodiment shown therein, the panel puller system 10 includes an anchor 1 such as a hook or plate, a tension line 2 such as a webbed strap, and a puller 3. A lever 4 is swivelingly or pivotally mounted on puller 3. These components and their manner of function in various embodiments are elucidated in the ensuing description and accompanying figures.

Figure 2:
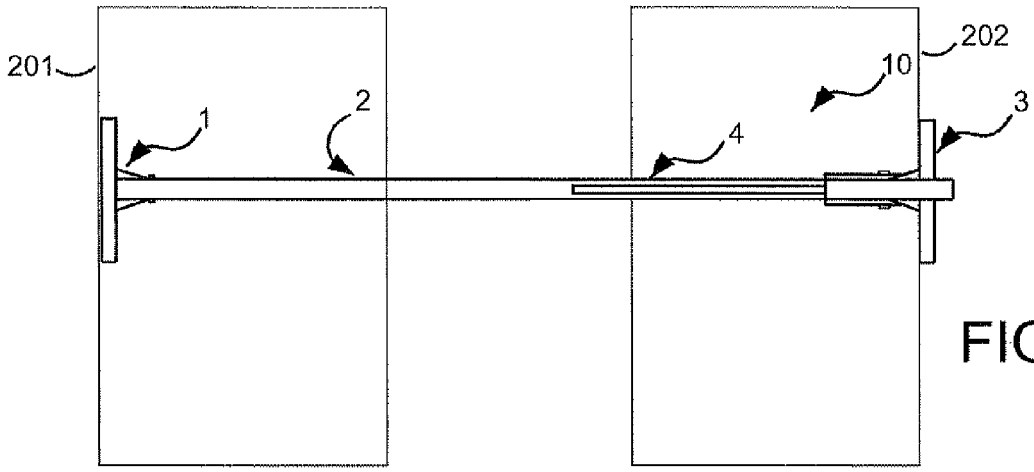
FIG. 2 depicts a top view of a panel puller system in context with wall panels according to one illustrative embodiment.

FIG. 2 depicts a side view of wall panels 201, 202 with a top view of a panel puller system 10, as it is oriented in the context of its use on the side of wall panels 201, 202, according to one illustrative embodiment. Hook anchor 1 is attached to a far end of a first Structured Insulated Panel (SIP) wall panel 201, which may be understood to be attached to a structure, while the second wall panel 202 is not yet attached to the structure. Puller 3 is attached to the free wall panel 202, and is connected to anchor 1 via tension line 2, which can be a webbed nylon strap, in this illustrative embodiment. Hook anchor 1 and puller 3 are both grippingly mounted on their respective wall panels 201 and 202, such that a hook component of each of them is engaged around a lip component of the wall panels, for example, the plywood or OSB board. Anchor 1 and puller 3 may also be mounted on the wall panels by means of other types of fasteners such as but not limited to screws, lag bolts or clamps, for example toggle clamps.

Figure 3:
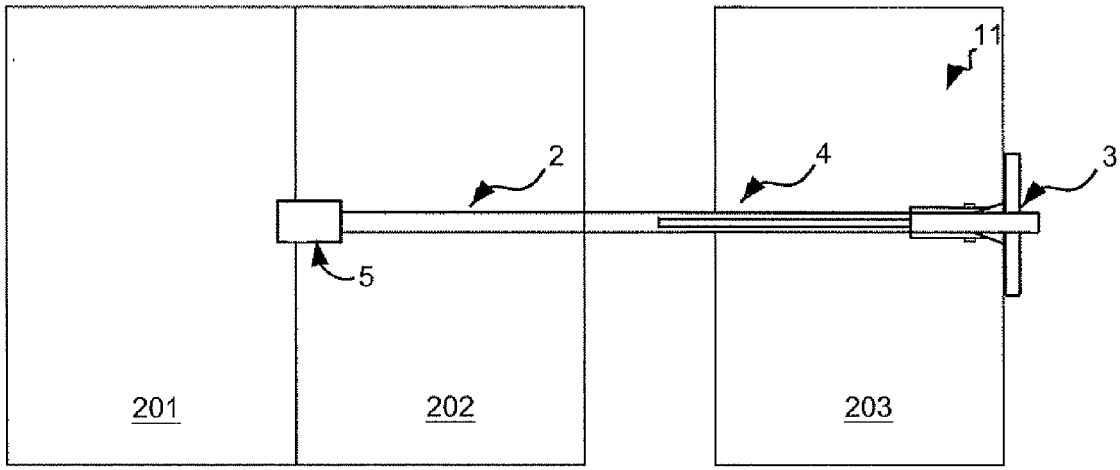
FIG. 3 depicts a top view of a panel puller system in context with wall panels according to one illustrative embodiment.

FIG. 3 depicts a top view of a panel puller system 11 in context with wall panels 201, 202, 203 according to another illustrative embodiment. Panel puller system 11 shares tension line 2, puller 3 and lever 4 with panel puller system 10 of FIG. 2, but includes plate anchor 5 in place of hook anchor 1. In FIG. 3, wall panel 202 has been previously pulled together into a snug fit with wall panel 201 by means of panel puller system 10. Panel puller system 11 is then used to pull panel 203 against panel 202. However, it should be noted that in one embodiment panel puller system 11 can be formed from panel puller system 10 by interchanging hook anchor 1 with plate anchor 5.

Plate anchor 5 has a flat face with screw-holes, and can be mounted to a panel 202 with only a flat face and no available lip, which was available with wall panel 201 in the context of FIG. 2. Puller 3 again is able to grippingly engage with a wall panel, here panel 203, and the puller system 11 is used to pull the wall panels 202, 203 together into a snug fit with each other, in a manner that is further elaborated on below.

FIG. 4 depicts prior art wall panels, to show an exemplary context in which embodiments of the panel puller system could be advantageously used. FIG. 5 depicts prior art roof panels, to provide yet another exemplary context in which an embodiment of the panel puller system could be advantageously used.

Figure 6:
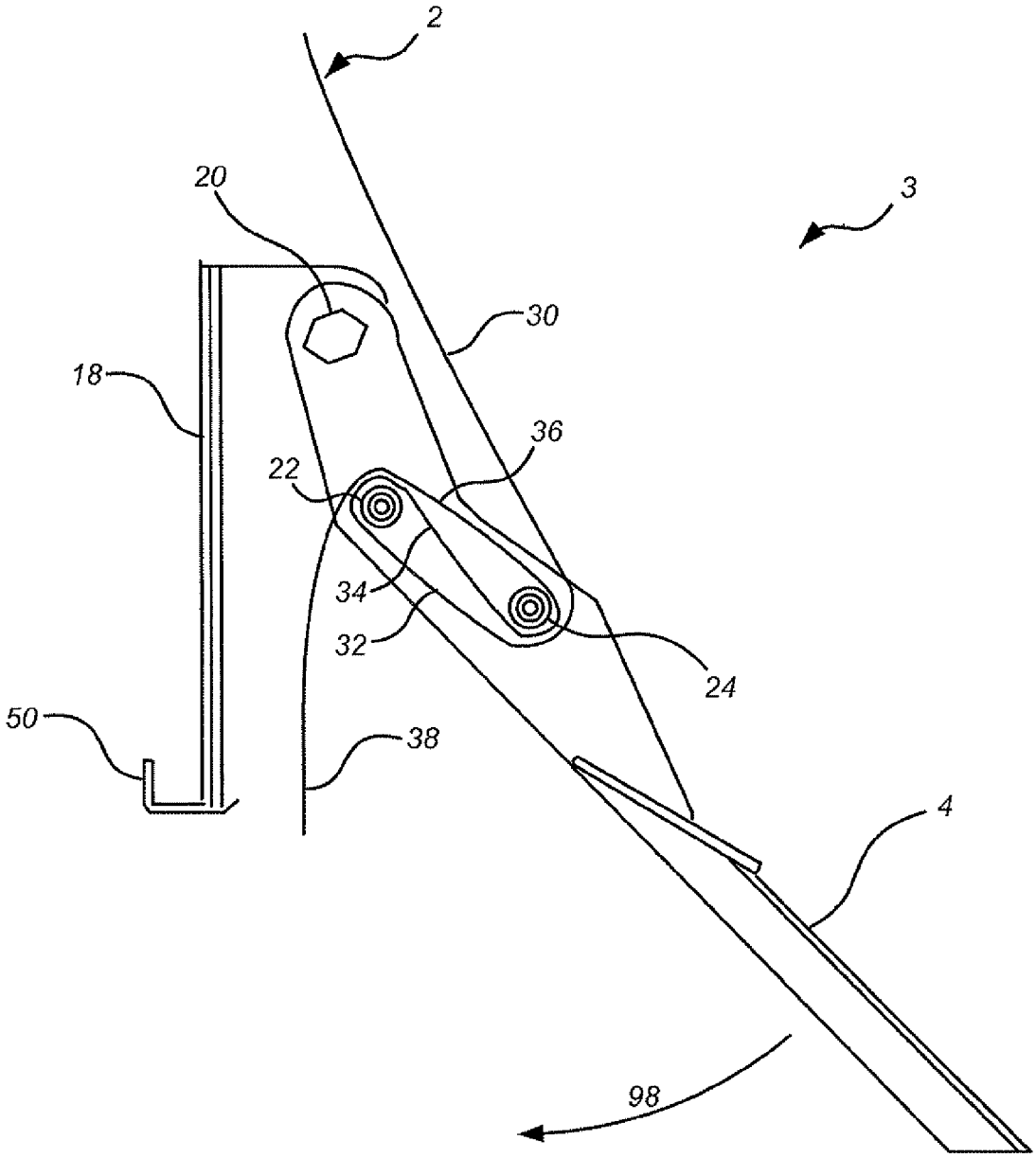
FIG. 6 depicts a side view of a puller component of a panel puller system according to one illustrative embodiment.

FIG. 6 depicts a side view of a puller component 3 of a panel puller system 10 or 11 according to one illustrative embodiment. Puller component 3 includes broad face 18, configured to contact a panel. Hook endgrip 50 is disposed at the end of broad face 18, and configured to grippingly engage a lip of a panel. Other types of endgrips and plate grips occur in other embodiments, illustratively including an L endgrip 405 in FIG. 22, and a spline plate grip 505 in FIG. 23. Similarly, the anchor holding the other end of strap 2 in place may take the form of a hook anchor, an L anchor, or a spline anchor, among other possibilities. Lever 4 is swivelingly or pivotally mounted on puller 3 about swivel joint 20. Tension line 2, a strap, is wound about a roller 22 and a roller 24 of puller 3. Simple pins may also be used instead of rollers, in other embodiments. Section 30 of strap 2 is disposed around roller 24; section 32 of strap 2 runs from roller 24 to and around roller 22; section 34 of strap 2 runs from roller 22 to and around roller 24, inwardly of section 30-32; section 36 of strap 2 runs from roller 24 back around roller 22; and section 38 of strap 2 leads from around roller 22 out of puller 3. Strap 2 is wound through puller 3 when lever 4 is oriented toward the anchor 1 (not depicted in FIG. 6). When lever 4 is pulled back away from the direction of anchor 1 and strap 2 as indicated by arrow 98, strap segments 30 and 36 become tautly pressed against each other, providing static friction sufficient to prevent any slippage of strap 2 with respect to puller 3. This taut friction contact becomes engaged somewhere in the middle of the range of lever 4, so that as lever 4 is further rotated away from the direction of anchor 1 in the direction of arrow 98, strap 2 is pulled ever more tautly. That is, the further rotation of lever 4 introduces ever greater tension in strap 2, with the tension constituting a force pulling anchor 1 and puller 3 closer together. When anchor 1 and puller 3 are each attached to a separate panel, this force therefore translates into a force pulling the two respective panels closer together. The puller system 10 therefore provides an efficient and effective mechanism for drawing two panels or other applicable objects together into a snug fit with each other, with the force on each spread out over a broad area (given the broad surface contact areas of both anchor 1 and puller 3), such that this mechanism for drawing the two panels together also does so with negligible to no damage to the panels.

Puller 3 also allows the lever 4, if rotated back far enough, to be go over center with respect to swivel joint 20, allowing the lever 4 to be held in that tensioned position with very little force. In an alternative embodiment, puller 3 is also equipped with a ratchet system, which may operate to allow lever 4 to rotate with respect to the swivel component of puller 3. Allowing the lever to rotate toward the direction of the anchor 1 with respect to the swivel portion of the puller 3 would be useful, for example, if the lever 4 is first pulled all the way back in the tensing direction (i.e. away from the direction of the anchor 1) but some slack remains in the strap 2, or not enough tension has yet been provided in strap 2. Rotating the lever in the direction of the anchor 1 freely of the puller would then allow the user to lock it with respect to the puller again and rotate it again in the tensing direction, until the strap has been provided with enough tension. On the other hand, being able to rotate the lever away from the direction of the anchor 1 independently of the puller 3 may be useful, for example, if the strap 2 has already become very taut and difficult to tighten further when the lever 4 has not yet rotated very far in the tensing direction. In this case, the ratchet system allows a user to lock the puller 3 in place without it going over center, allowing the user to free his hands while puller 3 remains in place. Alternately, allowing the lever 4 to release from the puller 3 and rotate freely away from the direction of the anchor, and then be locked with respect to the puller 3 again at a greater angle with respect to the strap, may allow the user to gain a greater mechanical advantage and become better able to rotate the lever 4 to tense the strap 2. Different embodiments may include a selected total lever length and/or a selected length of the lever portion between the farther roller 24 and the pivot joint 20, to optimize the level of mechanical advantage for a given application.

Figure 7:
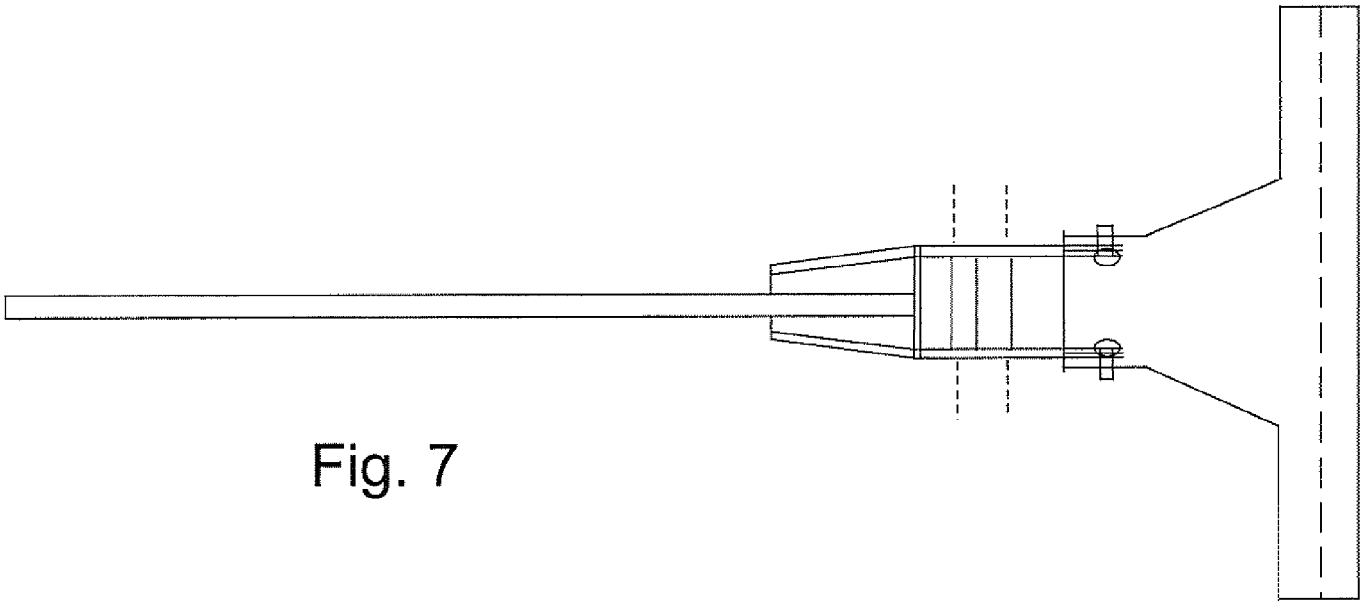
FIG. 7 depicts a top view of a puller component of a panel puller system according to one illustrative embodiment.
Figure 8:
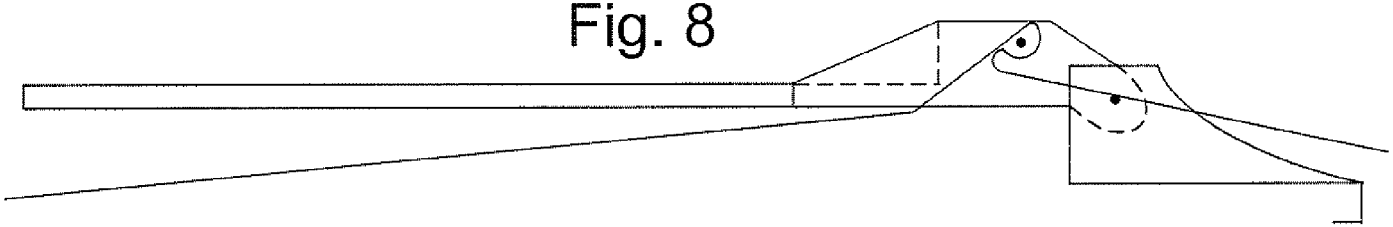
FIG. 8 depicts a side view of a puller component of a panel puller system according to one illustrative embodiment.
Figure 9:
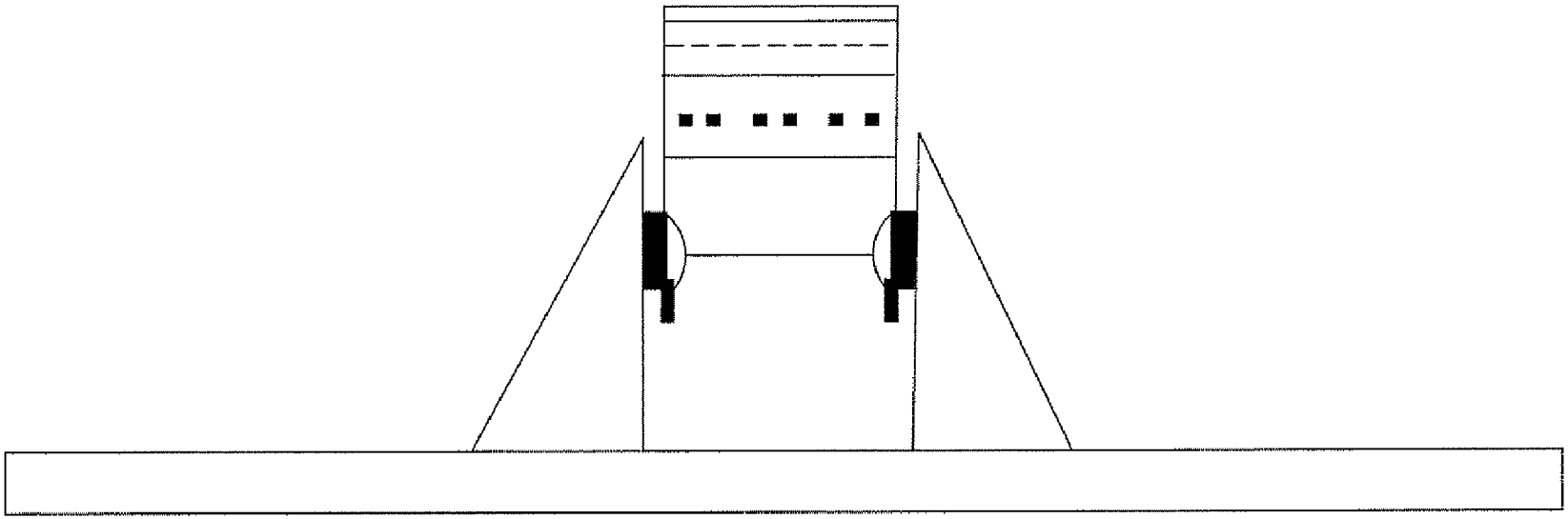
FIG. 9 depicts an end view of a puller component of a panel puller system according to one illustrative embodiment.

FIG. 7 depicts a top view of a puller component of a panel puller system according to one illustrative embodiment. FIG. 8 depicts a side view of the puller component, and FIG. 9 depicts an end view of the puller component of a corresponding embodiment. The specific measurements provided in FIGS. 7, 8, 9 and several of the following figures are presented to describe in detail certain particular illustrative embodiments only, with the understanding that other embodiments of the present invention may be characterized by a variety of other elements, and may occupy other forms as opposed to those depicted, that are still consistent with the invention. For example, the puller of FIGS. 7 and 8 is shown to have a plate and hook formation, which may be attached to one end or side of a panel, respectively, that is being assembled. In one embodiment, the hook may illustratively be composed of ¾ by ¾ by 16 inch (1.9 by 1.9 by 41 centimeter) u-iron that hooks around the end of the laminated sheathing (e.g. plywood, OSB, etc) on a typical SIP panel, in this illustrative embodiment. In other embodiments, a variety of other dimensions occur, both larger and smaller than ¾ by ¾ by 16 inch. A 16 inch wide hook is advantageous for spreading the amount of force exerted on the panels over a greater area. This eliminates the damage done to the ends of the panels under the current system of installation.

Figure 10A:
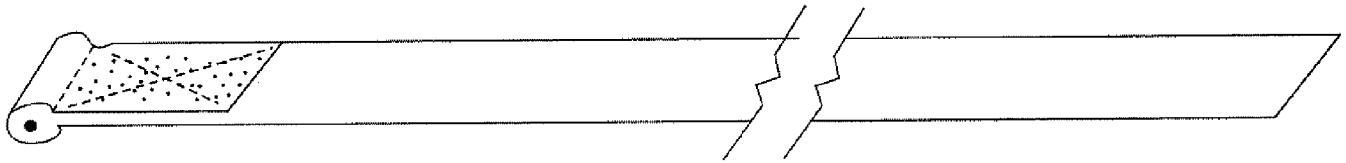
FIGS. 10A, 10B and 10C depict perspective, side and top views of a tension line component of a panel puller system according to one illustrative embodiment.
Figure 10B:
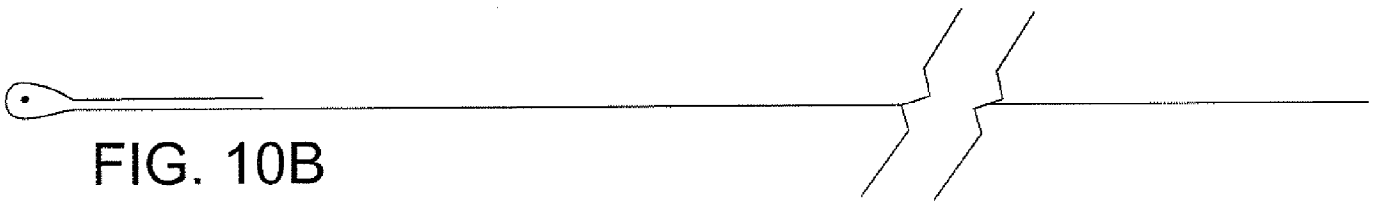
Figure 10C:
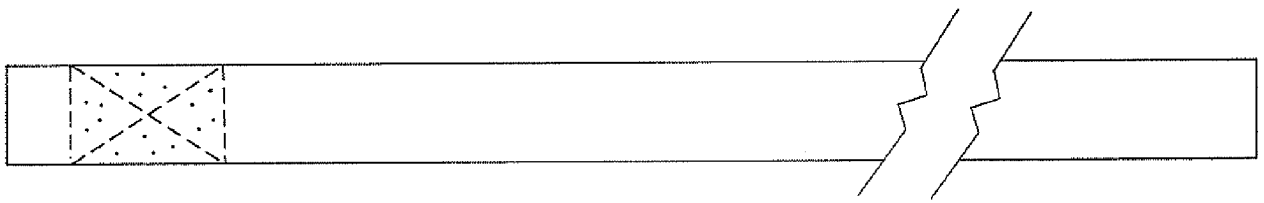
Figure 11B:
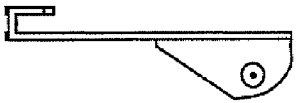
FIGS. 11A and 11B depict top and side views of an anchor component of a panel puller system according to one illustrative embodiment.
Figure 11A:
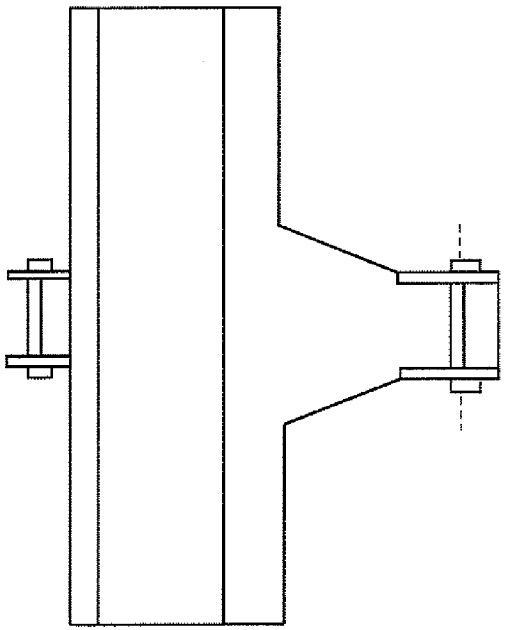
Figure 12E:
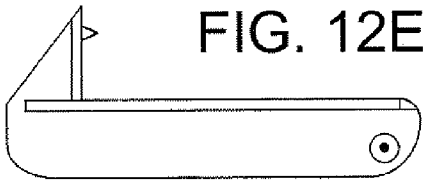
FIGS. 12C, 12D and 12E depict top, side and end views of an anchor component of a panel puller system according to one illustrative embodiment.
Figure 12D:
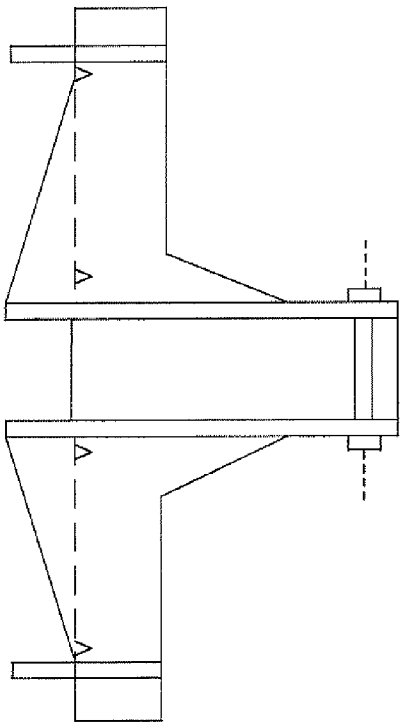
Figure 12C:
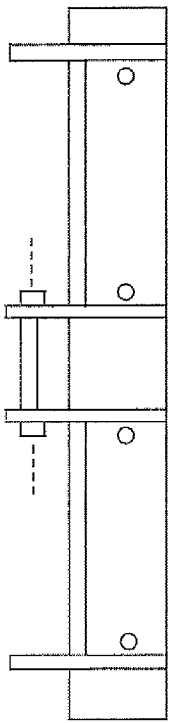
Figure 12A:
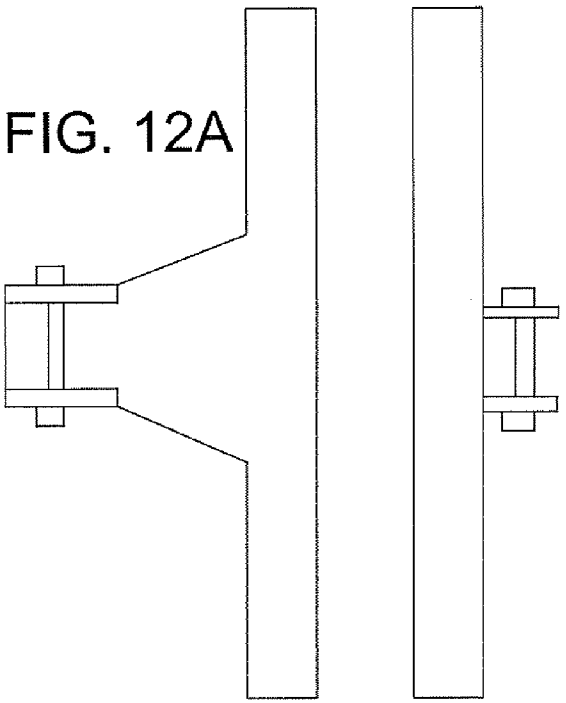
FIGS. 12A and 12B depict top and side views of an anchor component of a panel puller system according to one illustrative embodiment.
Figure 12B:
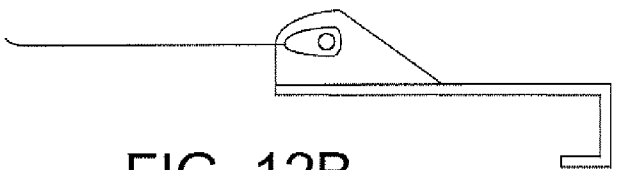

A strap is attached to the puller of FIGS. 7, 8, 9. FIGS. 10A, 10B and 10C depict perspective, side and top views of the strap, as one embodiment of a tension line component of the panel puller system, according to this illustrative embodiment. FIGS. 11A and 11B depict top and side views of a hook-formation anchor component of a panel puller system according to one illustrative embodiment. FIGS. 12A and 12B depict top and side views of a similar hook-formation anchor component of a panel puller system according to one illustrative embodiment.

Figure 11E:
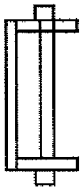
FIGS. 11C, 11D and 11E depict top, side and end views of an anchor component of a panel puller system according to one illustrative embodiment.
Figure 11C:
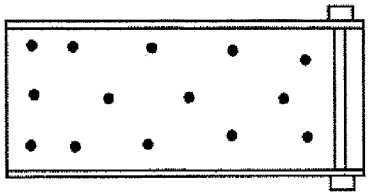
Figure 11D:
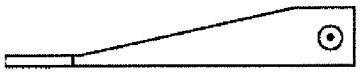

A flat, plate formation without a hook may also be used for the anchor when the hook does not lend itself to a particular application, such as when the anchor must be secured to a large, flat expanse without an appropriate lip to engage with a hook portion. FIGS. 11C, 11D and 11E depict top, side and end views of a flat plate anchor component of a panel puller system according to such an illustrative embodiment. The plate may come with predrilled holes that can be screwed into the panel splines of a previously installed panel section(s). As another embodiment of the anchor component, FIGS. 12C, 12D and 12E depict top, side and end views of an anchor component of a panel puller system according to one illustrative embodiment, where the anchor component has a right-angle portion with pins. This pinned form of the anchor may be advantageous in applications in which there is no available lip, such as a standard lip present on some panels, that could be used for a hook anchor to engage with, but where there is still a corner, rather than a flat expanse. The pinned angled form may then be fitted against a corner, with the pins providing relatively fixed contact points to help fix the anchor in place. A larger number of pins would help reduce the potential for minor damage to the surface contacted by the pins in such an embodiment.

Figure 13A:
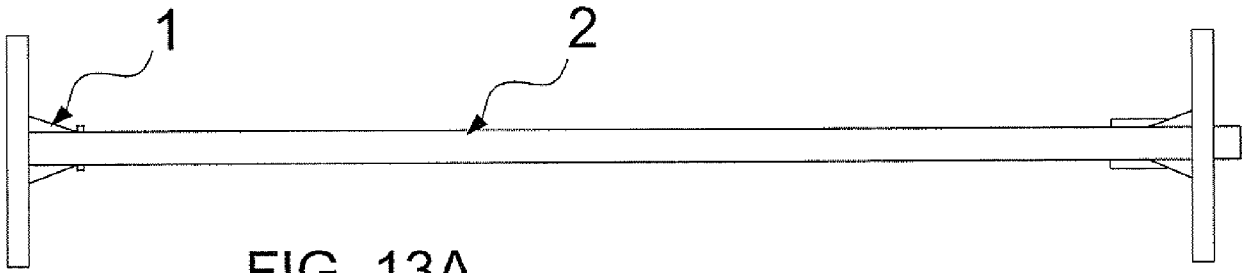
FIGS. 13A and 13B depict top and side views of a panel puller system according to one illustrative embodiment.
Figure 13B:
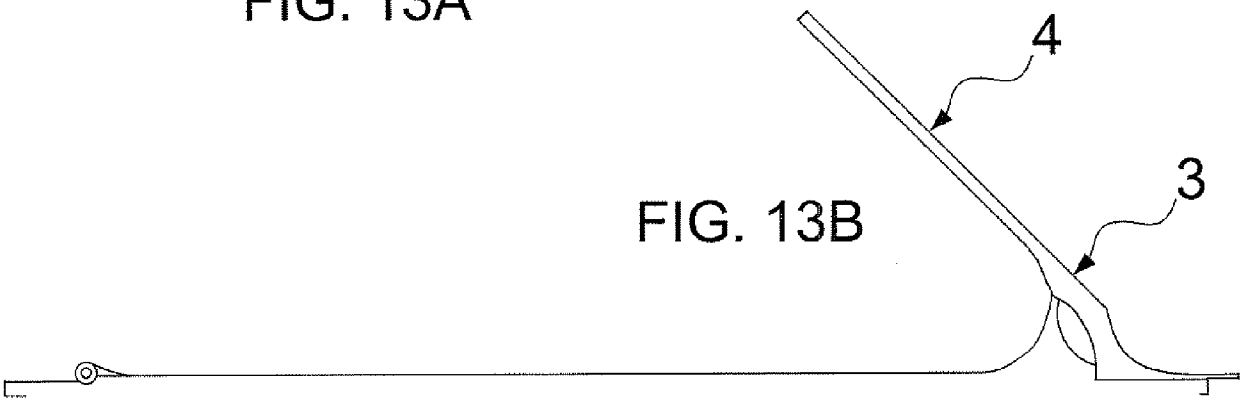
Figure 13C:
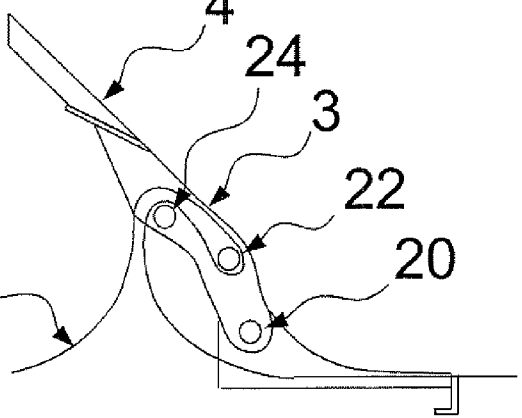
FIG. 13C depicts a side view of a puller component of a panel puller system according to one illustrative embodiment.
Figure 14:
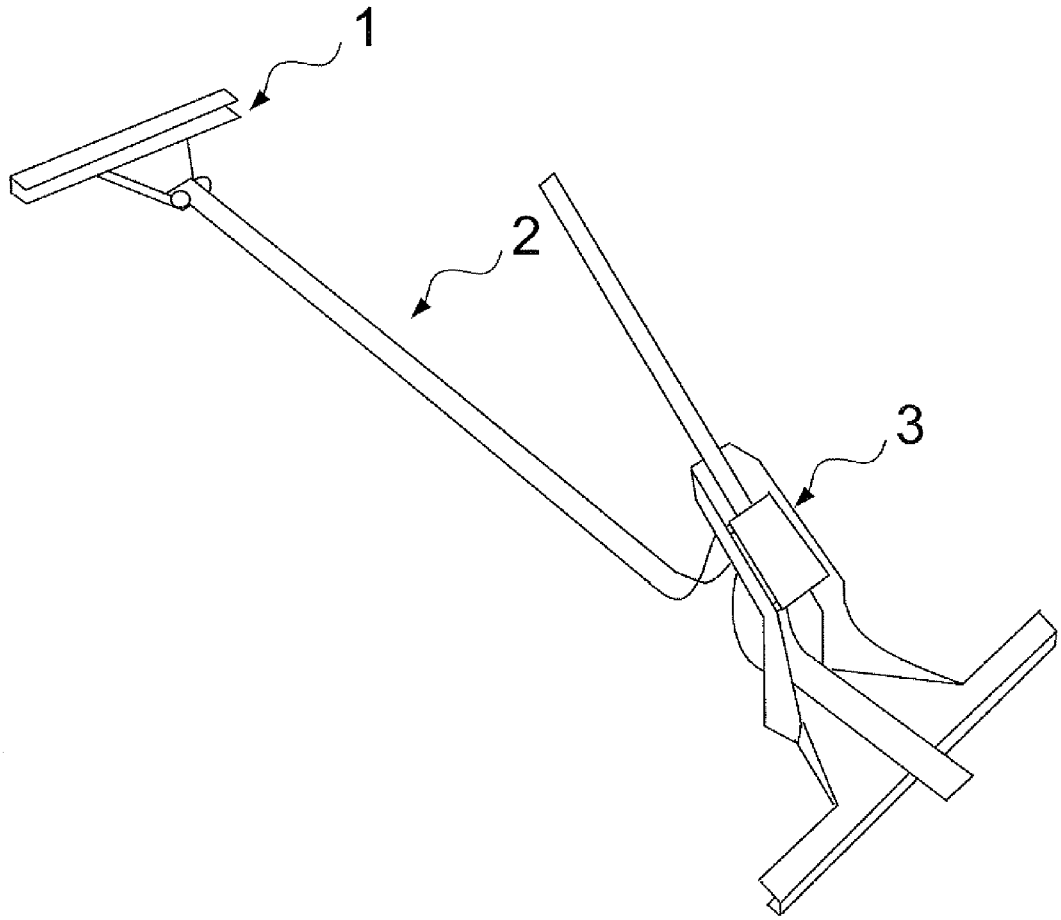
FIG. 14 depicts a perspective view of a panel puller system according to one illustrative embodiment.

FIGS. 13A and 13B depict top and side views of a panel puller system according to one illustrative embodiment. FIG. 13C depicts a side view of a puller component of the same panel puller system, and FIG. 14 depicts a perspective view of the same panel puller system. These four figures all depict the lever 4 of puller 3 angled relatively toward the direction of the anchor 1, in a position consistent with a slack strap, and in which the strap may more easily be threaded through the rollers 22, 24 of the puller 3. The puller 3 then can be hooked onto the end of the panel (not shown in these figures) that is being positioned into place. Once hooked, the slack of the strap 2 can be drawn out of the puller 3. A user may pull on a handle of the lever 4, which causes the lever to rotate back away from the direction of the anchor 1, i.e. in the tensing direction, clockwise as seen in the view of FIGS. 13B and 13C, around its central pivot point, which is the swivel joint 20. The rotation of the lever creates tension in the strap 2 (view section A-A). This tension causes the strap 2 to bind against itself on the outer roller 24. The tension is roughly proportional to the degree of rotation: the further around in the tensing direction the lever is rotated, the greater the tension becomes, and the greater the force becomes that in effect binds the strap to itself. This self-binding action ensures that the strap will not slip through the rollers 22, 24 as it pulls.

As the lever 4 continues to rotate, this tension has enough force to pull a heavy panel into place. Once the lever 4 has been rotated 180 degrees, the strap 2 and rollers 22, 24 pass over center and the puller 3 self-locks into place. This self-locking system functions without the need of any separate trigger or latching mechanism, in this illustrative embodiment. In other embodiments, a separate trigger or latching mechanism may be included to offer a supplemental locking mechanism to the self-locking of the strap.

Once the puller 3 is locked, the user is free to let go of the handle with no loss of tension, and can then ensure that the panel is secured in place. This takes a minimum amount of personnel and eliminates or significantly minimizes the need for hammering, prying, and ratcheting the panels into place, which as mentioned above, can damage the sides and edges of the panels. Once the panel is secured in place, the user can release the puller 3 by rotating the lever 4 back in the direction of the anchor 1, releasing the tension on the strap 2. Without tension on the strap 2, the operator then can freely pull any excess strap though the puller's rollers 22, 24, which immediately enables the user to hook onto a subsequent panel, if desired. This starts the whole process over again.

Figure 15A:
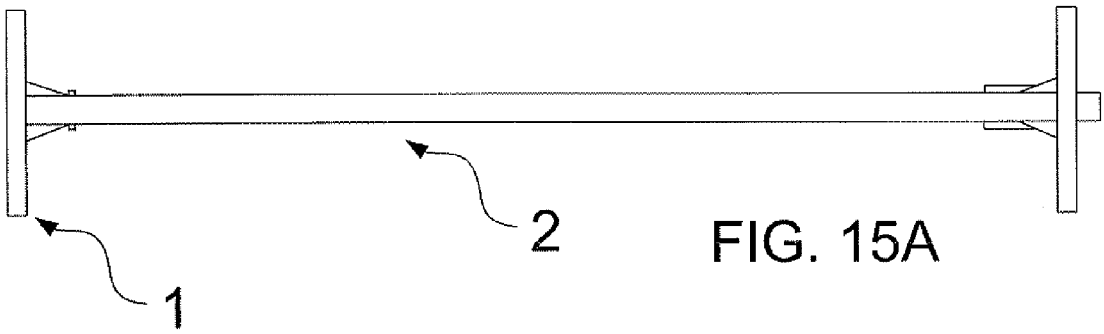
FIGS. 15A and 15B depict top and side views of a panel puller system according to one illustrative embodiment.
Figure 15B:
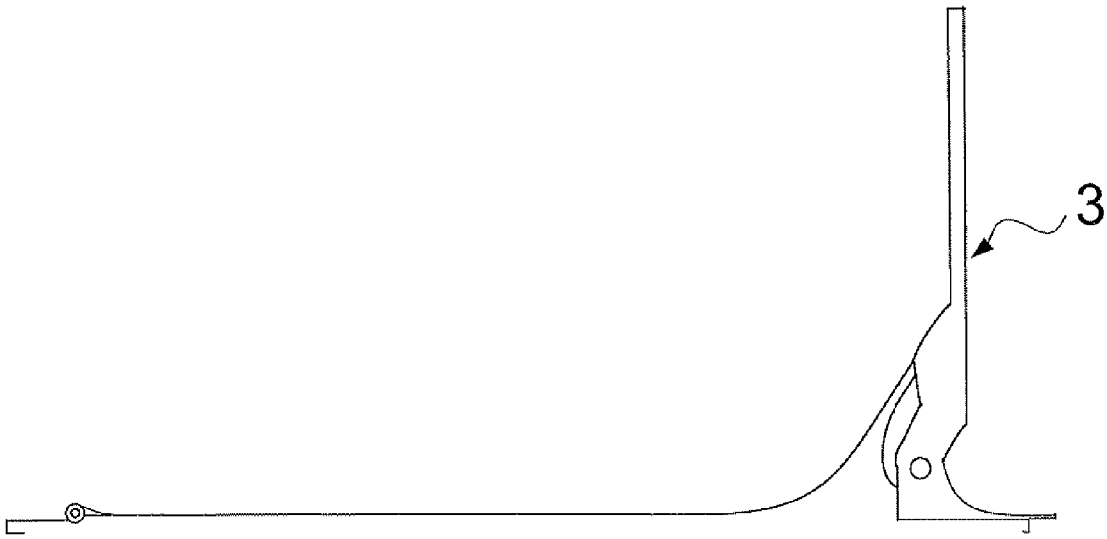
Figure 15C:
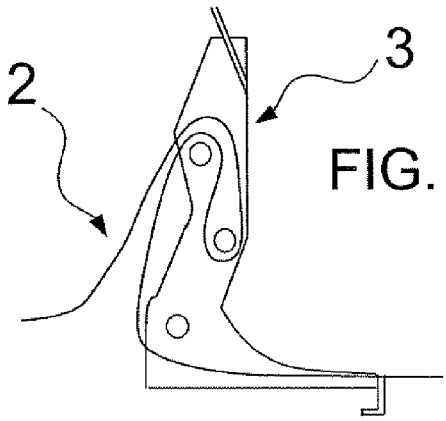
FIG. 15C depicts a side view of a puller component of a panel puller system according to one illustrative embodiment.
Figure 16A:
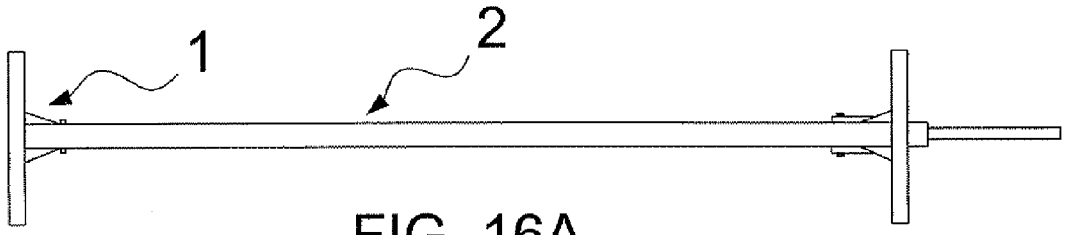
FIGS. 16A and 16B depict top and side views of a panel puller system according to one illustrative embodiment.
Figure 16B:
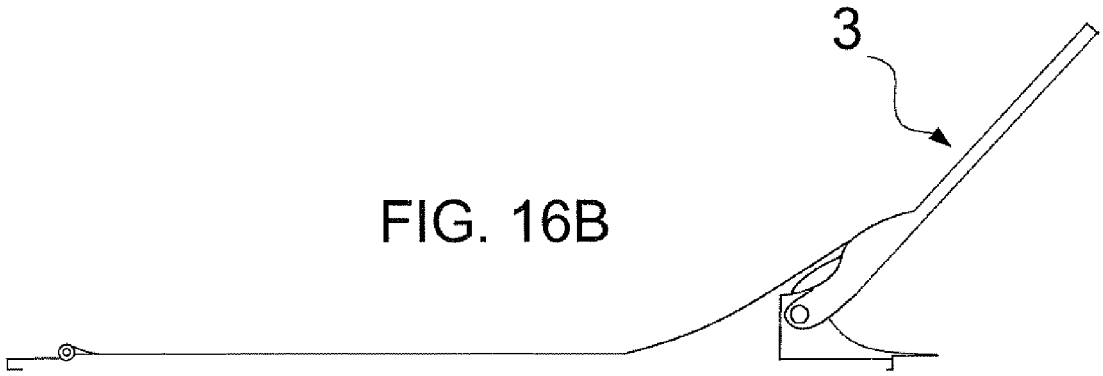
Figure 16C:
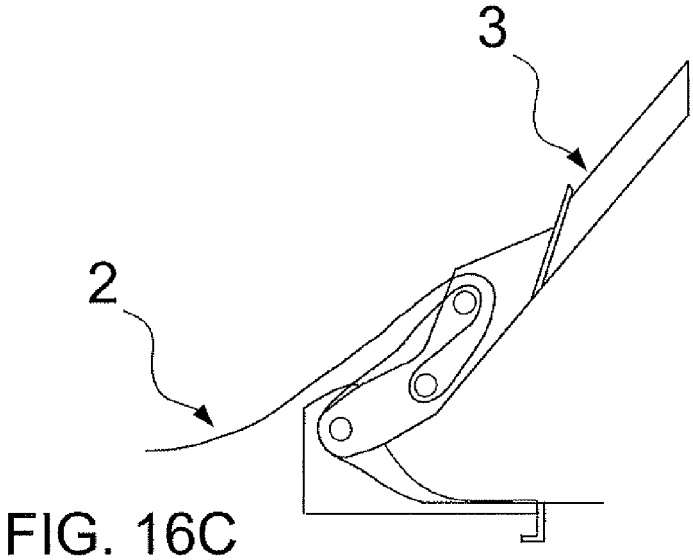
FIG. 16C depicts a side view of a puller component of a panel puller system according to one illustrative embodiment.
Figure 17A:
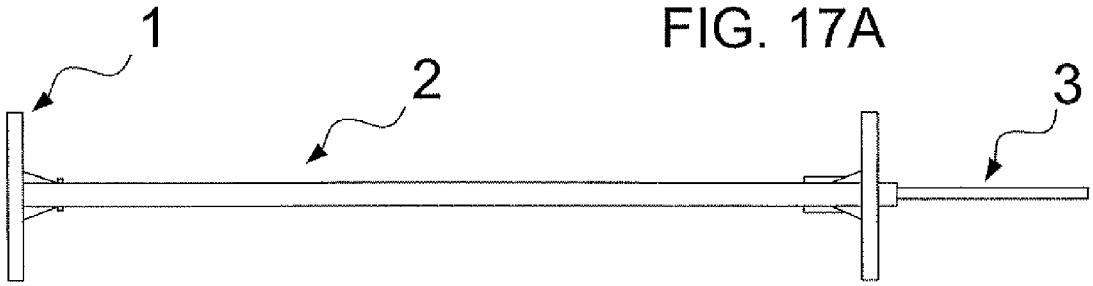
FIGS. 17A and 17B depict top and side views of a panel puller system according to one illustrative embodiment.
Figure 17B:
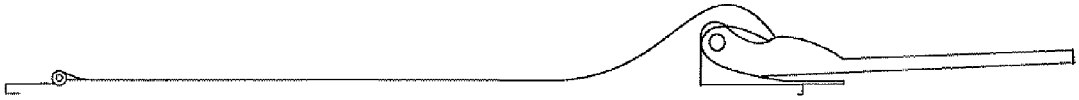
Figure 17C:
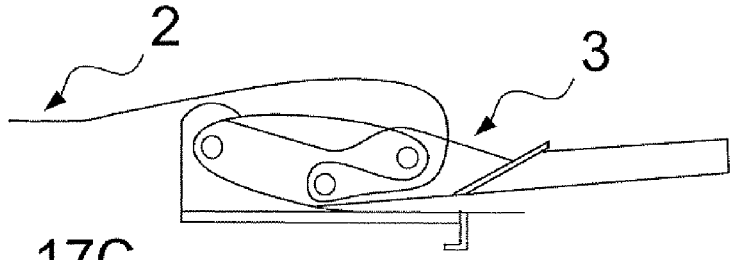
FIG. 17C depicts a side view of a puller component of a panel puller system according to one illustrative embodiment.

The next several figures help illustrate the levering and tensing mechanism of an illustrative embodiment of the panel puller system. FIGS. 13A, 13B, 13C and 14 depict the beginning of the levering process, with the lever and strap at an angle of about 45 degrees relative to each other. FIGS. 15A and 15B depict top and side views of the panel puller system, and FIG. 15C depicts a side view of the puller component, when the lever has been rotated in the tensing direction to the point at which the lever has about a 90 degree angle with the strap 2. FIGS. 16A and 16B depict top and side views, and FIG. 16C depicts a side view of the puller component, when the lever has been further rotated in the tensing direction to the point at which the lever has about a 135 degree angle with the strap 2. Finally, FIGS. 17A and 17B depict top and side views, and FIG. 17C depicts a side view of the puller component, when the lever has been still further rotated in the tensing direction to the point at which the lever has about a 180 degree angle with the strap 2. At some angle between 45 degrees and 180 degrees, the strap 2 has become self-bound in its windings through puller 3, after which the total length increase in the tensed portion of strap 2 is roughly equal to the distance between the pivot joint 20 and the more distant roller 24 from the pivot joint 20, times the cosine of the angle formed between the lever 4 and the strap 2 as the lever 4 is rotated in the tensing direction, in accordance with one illustrative embodiment.

Figure 18:
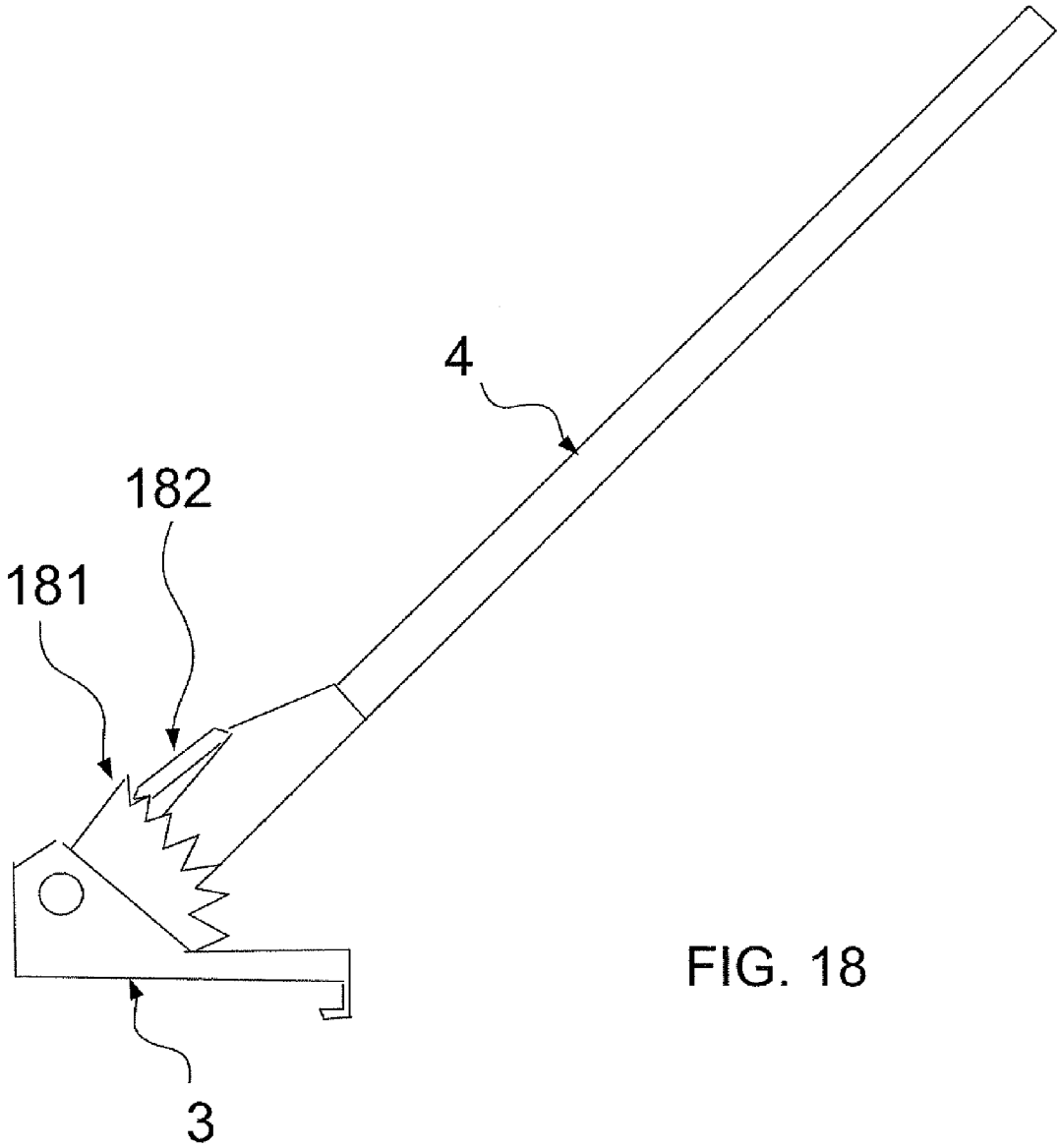
FIG. 18 depicts a side view of a puller component of a panel puller system according to one illustrative embodiment.

FIG. 18 depicts a side view of a puller component of a panel puller system according to one illustrative embodiment, which includes a locking ratchet 181 with a circular array of teeth, and a locking component 182 that can be engaged in any of the teeth of ratchet 181 to lock the lever 4 at a selected orientation with respect to puller 3, as described above.

Figure 19B:
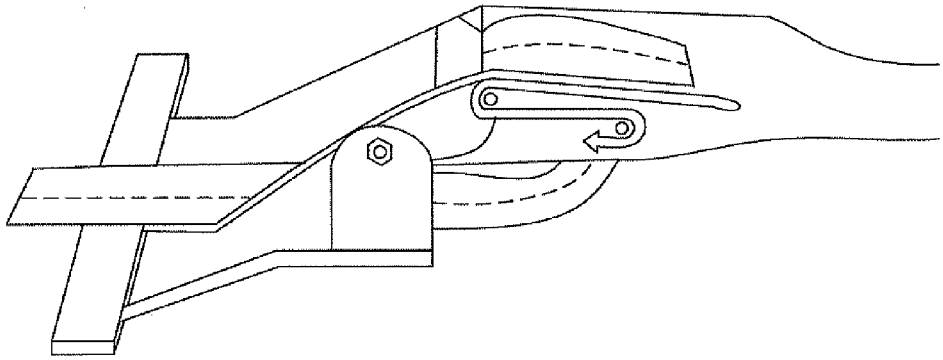
FIGS. 19A, 19B and 19C depict perspective views of a panel puller system according to one illustrative embodiment.
Figure 19A:
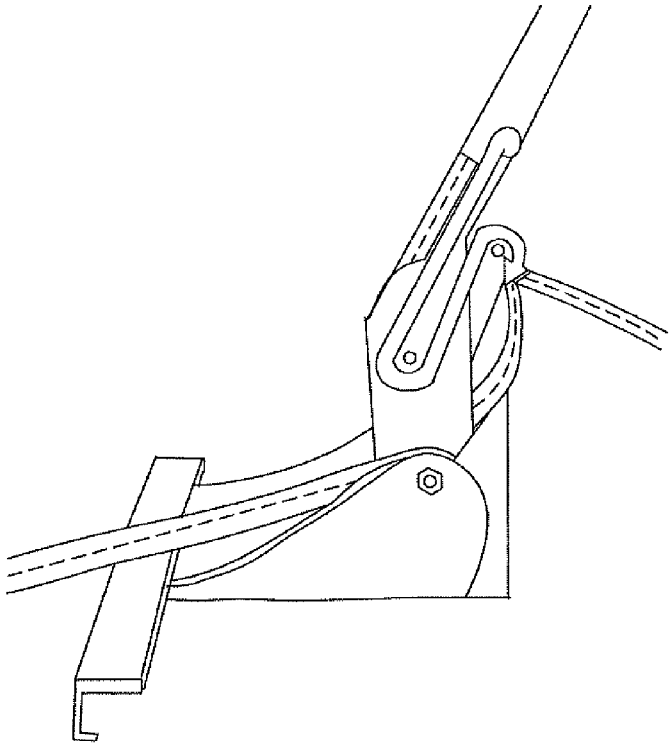
Figure 19C:
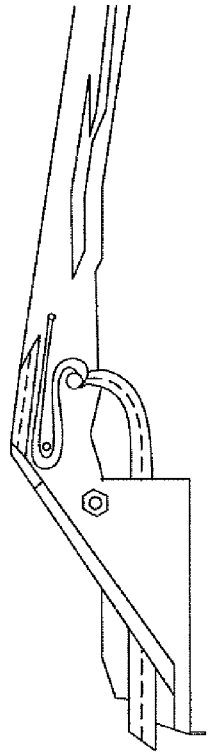

FIG. 19A depicts a perspective view of a panel puller system according to one illustrative embodiment, with the lever at about a 75 degree angle to the strap. FIGS. 19B and 19C depict perspective views of the same panel puller system, with the lever at about a 0 degree angle to the strap. It is understood that the angle to the strap refers to the angle to the tensed portion of the strap between the puller 3 and the anchor 1.

Figure 20:
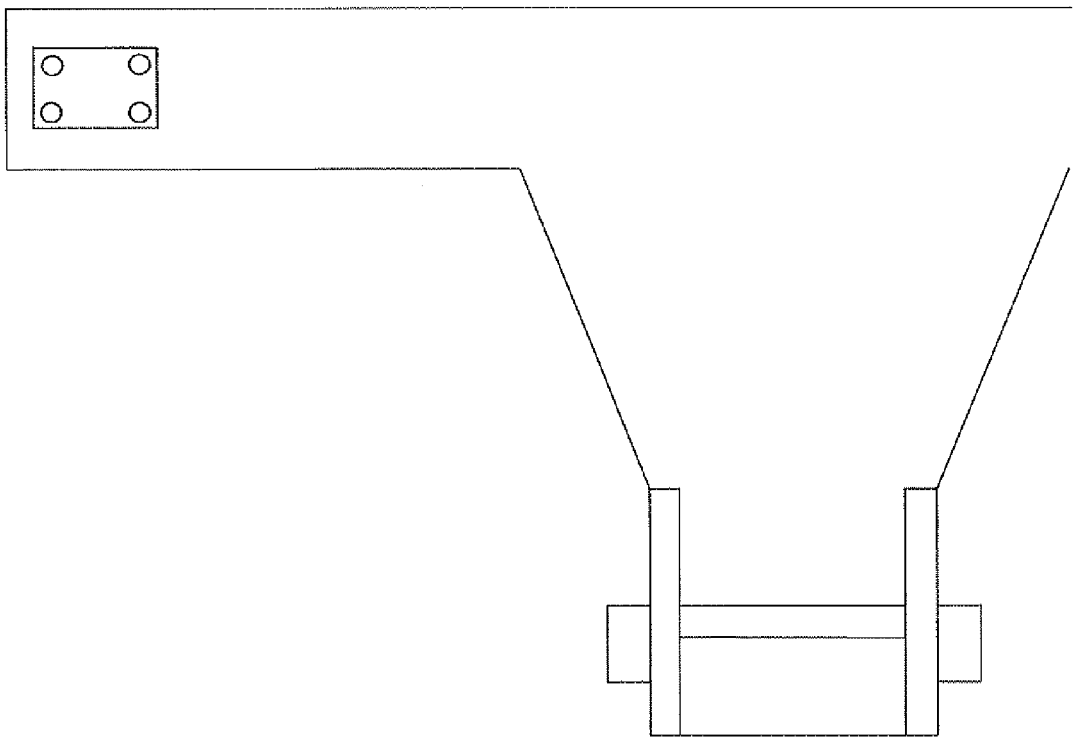
FIG. 20 depicts a toggle clamp component of a panel puller system according to one illustrative embodiment.

FIG. 20 depicts a toggle clamp component of a panel puller system according to one illustrative embodiment. Toggle clamps are well known. The toggle clamp components provide an alternative mechanism for securely mounting the anchor or the puller to a surface. Clamps such as the toggle clamp may also be used for keeping the anchor or puller in place vertically, when used on vertical subjects such as wall panels, during setup.

Some other illustrative embodiments incorporate a variety of additional features, which can be used alone or in combination. The features include for example: D-plates for fastening to and manipulating panels; mechanisms such as spur gears, for allowing the rotating action of a puller to be directed in a direction toward the face of the panel rather than away from it; an under-center rather than over-center gear, or a pin added to the puller body to keep the strap tension close to parallel with the face of the panel; a gear ratio raising the angular displacement of the roller or pin relative to the angular displacement of the lever; and an endgrip anchor having teeth, to encourage a secure anchoring, particularly at difficult-to-anchor spots such as a corner or a stud; among other additional features. Each of these additional features is described in turn as follows.

Figure 21:
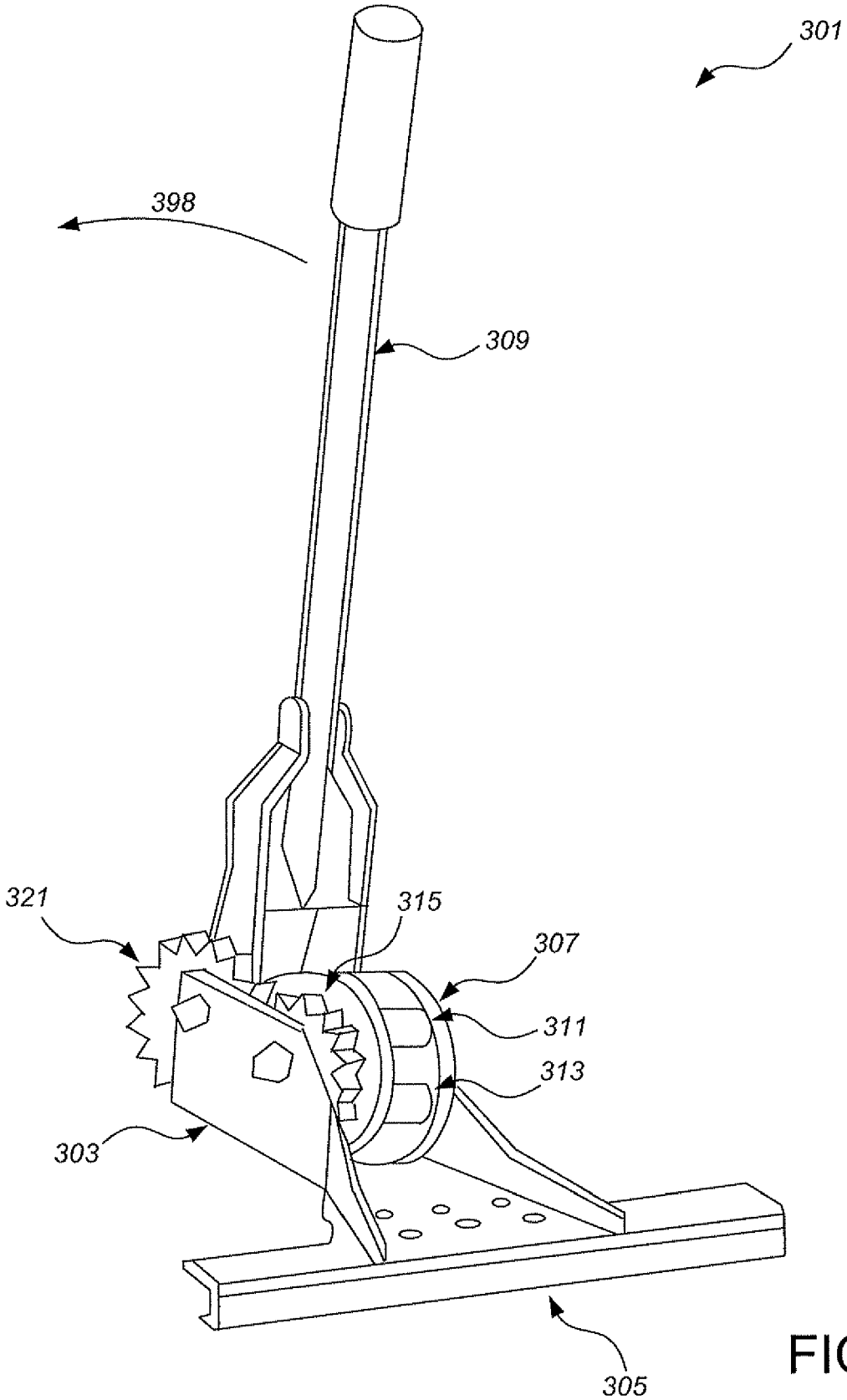
FIG. 21 depicts a puller according to another illustrative embodiment.

FIG. 21 depicts a puller 301 according to another illustrative embodiment. Puller 301 includes body 303, endgrip 305 integrated with body 303, wheel 307 rotatably mounted on body 303, and lever 309 also rotatably mounted on body 303. Wheel 307 includes representative rollers 311, 313 and wheel gear 315. Lever 309 includes spur gear 321 mounted thereto, which engages wheel gear 315, such that when lever 309 is rotated in one direction, its engagement with wheel gear 315 induces wheel gear 315 to rotate in the opposite direction.

This configuration allows a user to pull lever 309 toward a panel face in direction 398 to tighten the panel (panel not depicted in FIG. 21), when endgrip 305 is mounted onto one edge of a panel and puller 301 is used to fittingly pull that panel against another panel already in place. This has been found to provide substantial advantages in some applications, over a puller requiring the lever to be rotated away from the panel face, as in the embodiments described in some of the illustrative embodiments above, including as depicted in FIGS. 1 and 6, though those embodiments are also advantageous for other applications. Among the advantageous applications for a puller 301 according to the embodiment of FIG. 21 is in assembly of roof panels. In this application, if the user were to pull the lever away from the panel face to tighten the panel into place, the user would have to be leaning over the upper edge of the panel being fitted, with a free fall on the other side of that upper edge. The embodiment of FIG. 21 enables the user to remain away from the upper edge, and to pull the lever 309 in a direction toward which there is the solid support of the already installed roof. This constitutes another inventive and advantageous aspect of puller 301 according to the illustrative embodiment depicted in FIG. 21.

Figure 22:
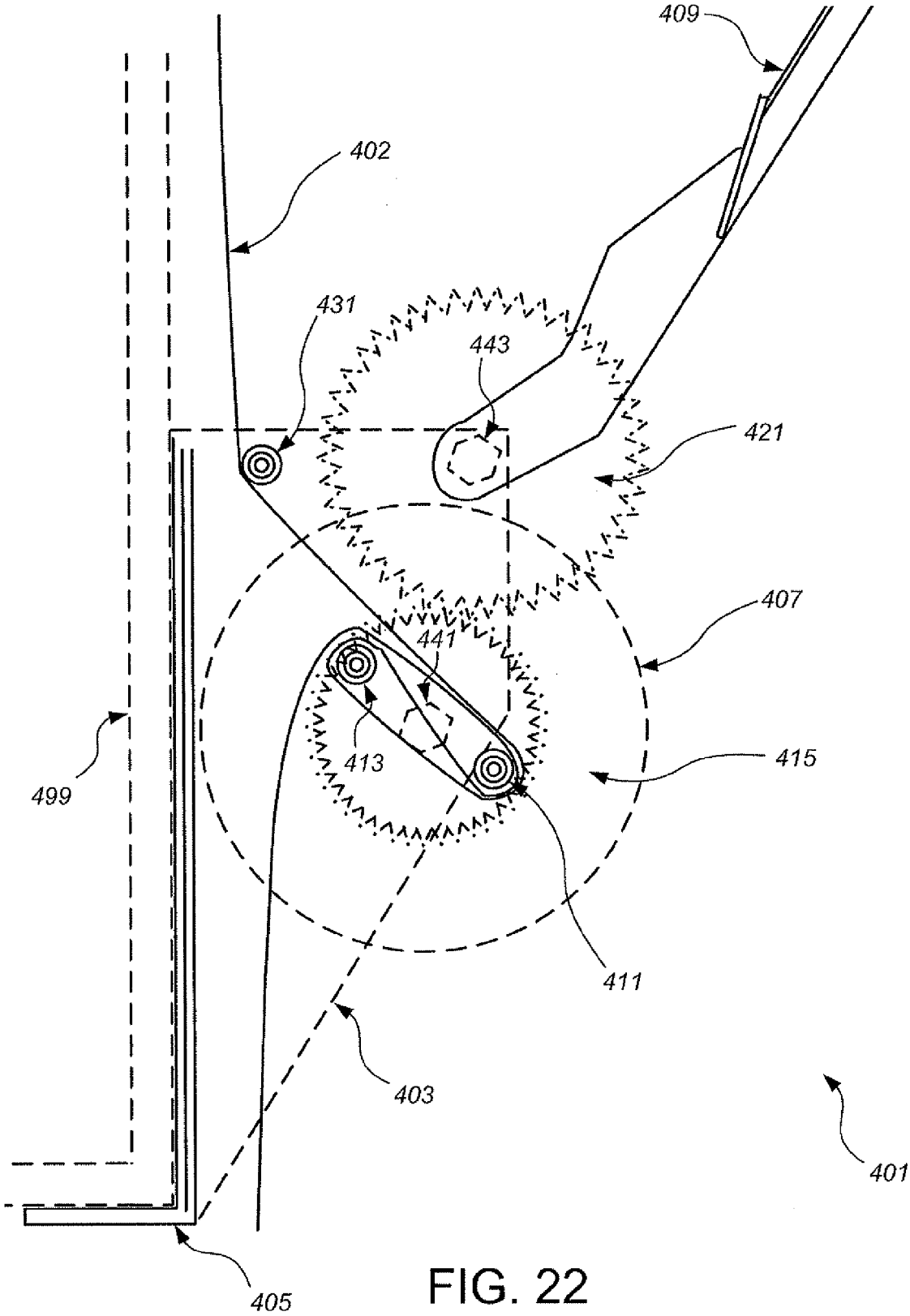
FIG. 22 depicts a puller according to another illustrative embodiment.

FIG. 22 depicts a more detailed look at a puller 401 similar in some ways to puller 301 of FIG. 21. Puller 401 includes body 403, L endgrip 405 integrated with body 403, wheel 407, lever 409, and roller 431. Wheel 407 is rotatably mounted on body 403 by swivel mount 441, and lever 409 is rotatably mounted on body 403 by swivel or pivot mount 443. L endgrip 405 is temporarily mounted on corner panel 499, and is "L" shaped to allow it to conform to the shape of the corner. L endgrip 405 may also include teeth or screw-holes, to help secure it in position on the corner panel 499. Wheel 407 includes rollers 411, 413 and wheel gear 415. Lever 409 includes spur gear 421 mounted thereto, which engages wheel gear 415, such that when lever 409 is rotated in one direction, its interface with wheel gear 415 induces wheel gear 415 to rotate in the opposite direction. As can be seen, after strap 402 is threaded through rollers 431, 411, and 413, and lever 409 is pulled toward the face of panel 499 to which L endgrip 405 is mounted—that is, counterclockwise as according to the depiction of FIG. 22—then the segments of strap 402 that are threaded through roller rollers 411, 413 become tautly pressed against each other, providing static friction sufficient to prevent any slippage of strap 402 with respect to puller 401. As lever 409 is further rotated toward the face of panel 499, strap 402 is pulled ever more tautly, thereby exerting substantial tension through strap 402 and forcing panel 499 to be tightly pulled into place alongside another panel or other building component.

FIG. 22 also demonstrates that spur gear 421 has a smaller radius than wheel gear 415 in the present illustrative embodiment, so that a relatively greater angular displacement of wheel 407 is achieved by rotating lever 409. For example, the gear ratio between spur gear 421 and wheel gear 415 may illustratively be about 0.55 to 0.60 in one embodiment, so that an angular displacement of 180 degrees in wheel 407 may be achieved by pulling and rotating the lever about an angle of only about 105 degrees. This leverages the action of the user in such a way that is more convenient in some applications, where a single turn of the lever of 105 degrees allows the user to exert sufficient tension through the strap 402 to fittingly place the panel 499, without having to begin with the lever too far extended away from the panel face, and without making the lever too difficult to pull, as might be the case if the gear ratio is made much more substantial. In other embodiments, however, any other gear ratio may be applicable, to suit uses with a wide variety of characteristics. This may simply be a gear ratio of 1; or it may be smaller than that of puller 401, enabling the user to exert more tension with less rotation of lever 409; or it may be greater than 1, to give the user a better mechanical advantage for exerting tension where that is relatively difficult. Any of these options, and the latter variation in particular, may be accompanied by a ratchet to facilitate the lever being pumped through more than one rotation until sufficient tension has been exerted.

FIG. 22 also depicts roller 431 mounted to body 403, which strap 402 is threaded around. Roller 431 further ensures that the tension along strap 402 remains relatively parallel to the face of panel 499, to help prevent the possibility of a significant component of the tension acting orthogonal to panel 499, thereby possibly tending to bow panel 499 toward a "U" shape, rather than longitudinally to force panel 499 into place. In a different embodiment, roller 431 may be omitted.

Figure 23:
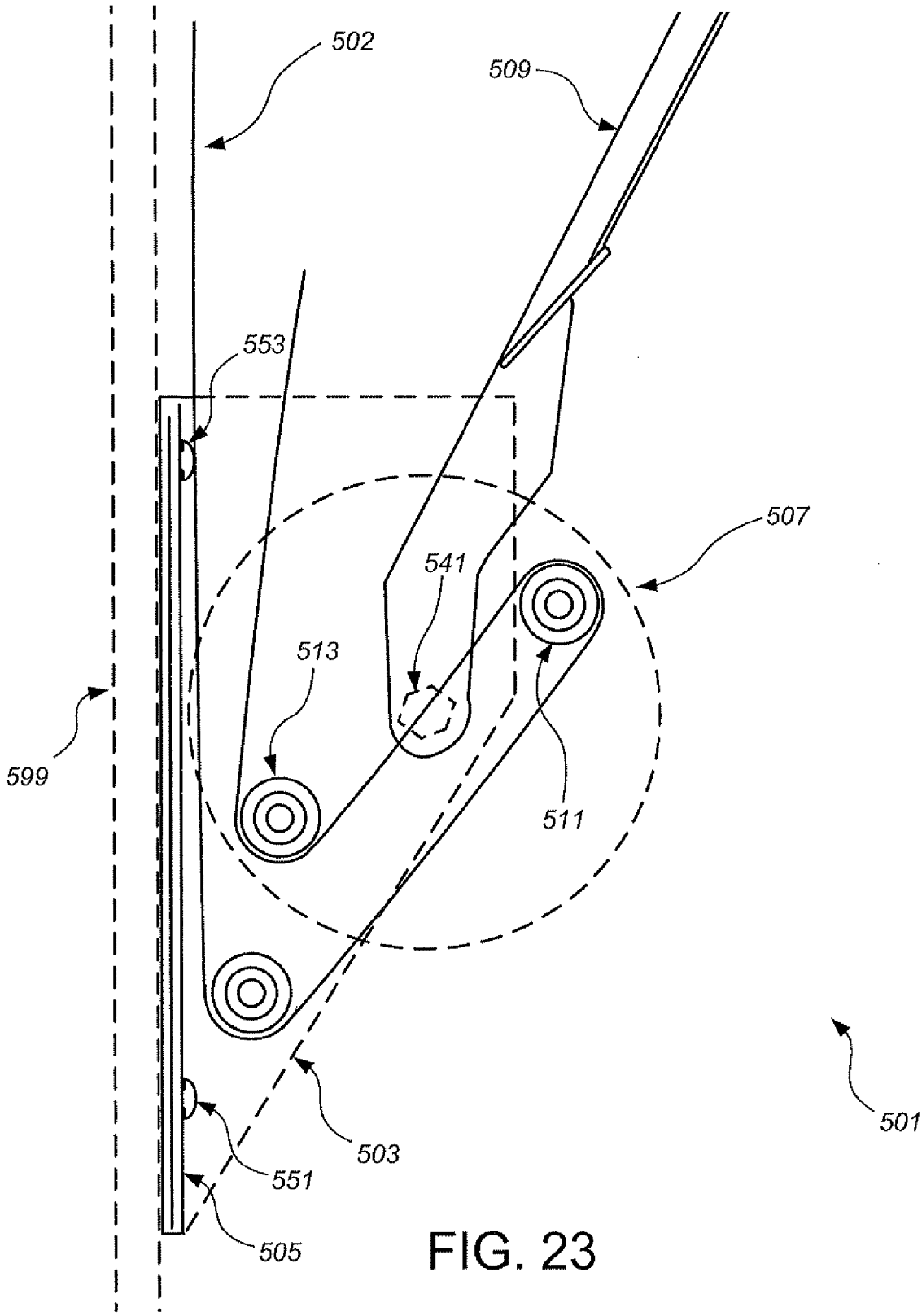
FIG. 23 depicts a puller according to another illustrative embodiment.

FIG. 23 depicts another illustrative embodiment of a puller. Puller 501 includes body 503, spline plate grip 505, wheel 507, and lever 509, and provides another embodiment that does not include spur gearing such as in FIG. 22. Lever 509 is fixedly attached to wheel 507. Wheel 507 and lever 509 together are rotatably mounted on body 503 by swivel or pivot mount 541. Spline plate grip 505 is temporarily mounted on panel 599. Spline plate grip 505 is an alternative to the hook endgrip 50 of FIG. 6 and the L endgrip 405 of FIG. 22. Spline plate grip 505 has a flat face with screw-holes that receive representative screws 551, 553, so that it may be fastened to a flat surface, which is particularly useful when edges or corners are unavailable. Wheel 507 includes rollers 511 and 513. Strap 502 is threaded through rollers 511, 513 of wheel 507 such that when lever 509 is pulled and rotated toward the face of panel 599, counterclockwise in the depiction of FIG. 23, it induces the segments of strap 502 that are threaded through roller rollers 511, 513 to become tautly pressed against each other, preventing slippage of strap 502 while exerting tension through strap 502 to force panel 599 to be tightly pulled into place alongside another panel or other building component. Puller 501 therefore provides another embodiment in which the user pulls the lever toward rather than away from the face of the panel being fitted into place, which may be advantageous for some applications as indicated above with reference to FIG. 22. By pulling the strap under center rather than over center, puller 501 also inherently keeps the vector of the tension exerted by strap 502 very close and relatively parallel to the face of panel 502, thereby ensuring that all but possibly a negligible component of the tension force in strap 502 is usefully applied to pulling panel 599, rather than being wasted and potentially counterproductive as an orthogonal force component, as indicated above with reference to FIG. 22.

Figure 24:
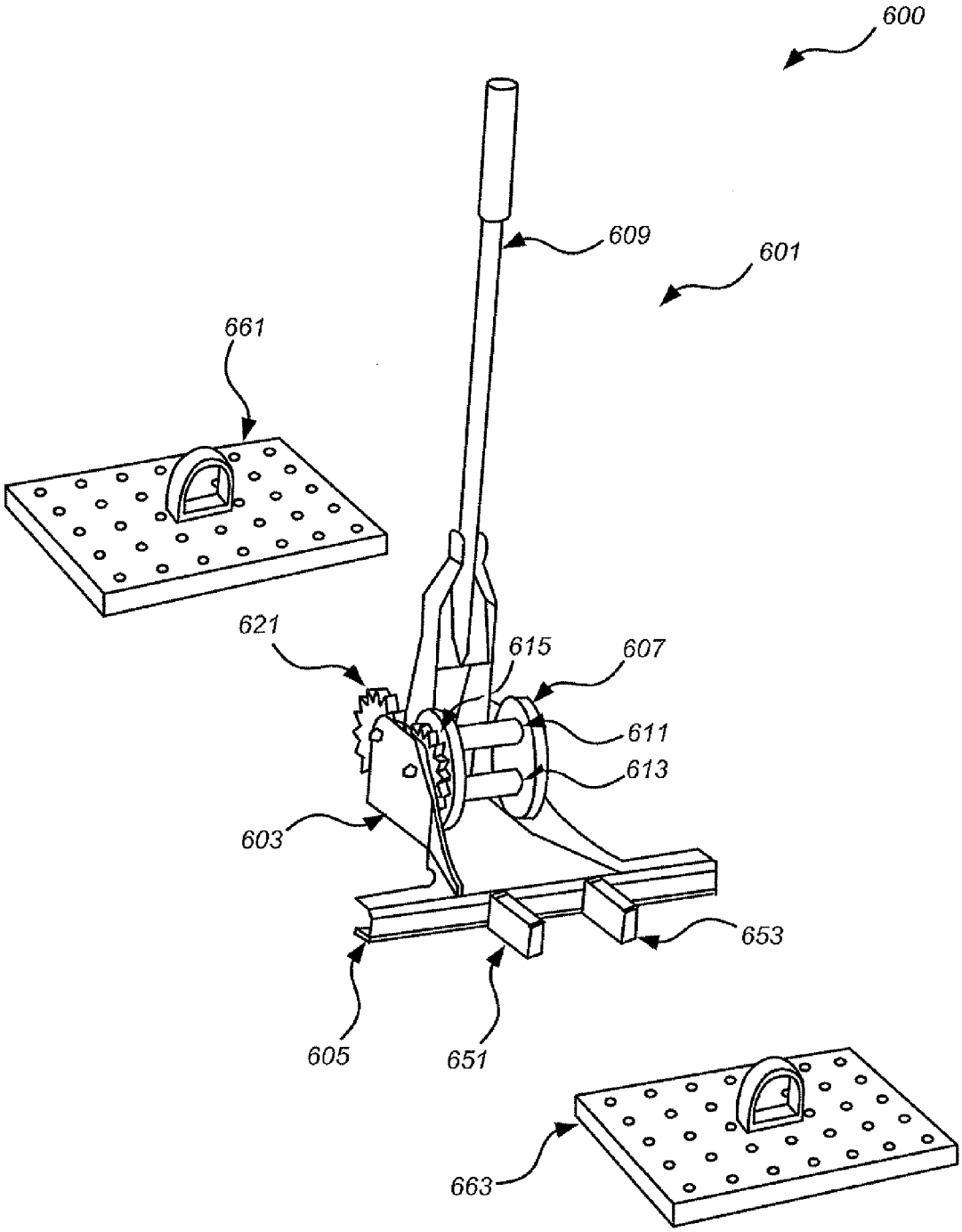
FIG. 24 depicts a puller system with puller and other associated components, according to another illustrative embodiment.

FIG. 24 depicts another embodiment of a puller, along with associated components that are also comprised in a puller system according to this embodiment. Puller 601 includes many comparable components to those described above, including body 603, endgrip 605, wheel 607, lever 609, rollers 611 and 613, wheel gear 615, and spur gear 621. Puller 601 also includes anchor tabs 651 and 653 integrated with body 603; and puller 601 is part of a puller system 600 that also includes D-plates 661 and 663, which provide additional options for providing secure attachments to a panel. D-plates 661 and 663 each include a D-shaped ring, securely anchored to a flat plate perforated with several holes through which screws or nails may be passed. D-plate 661 may be used as another option for attaching the far end of a strap (strap not depicted in FIG. 24) to a panel or other building component that is already in place. D-plate 661 is depicted and described in closer detail, before the remaining discussion of FIG. 24, as follows.

Figure 25:
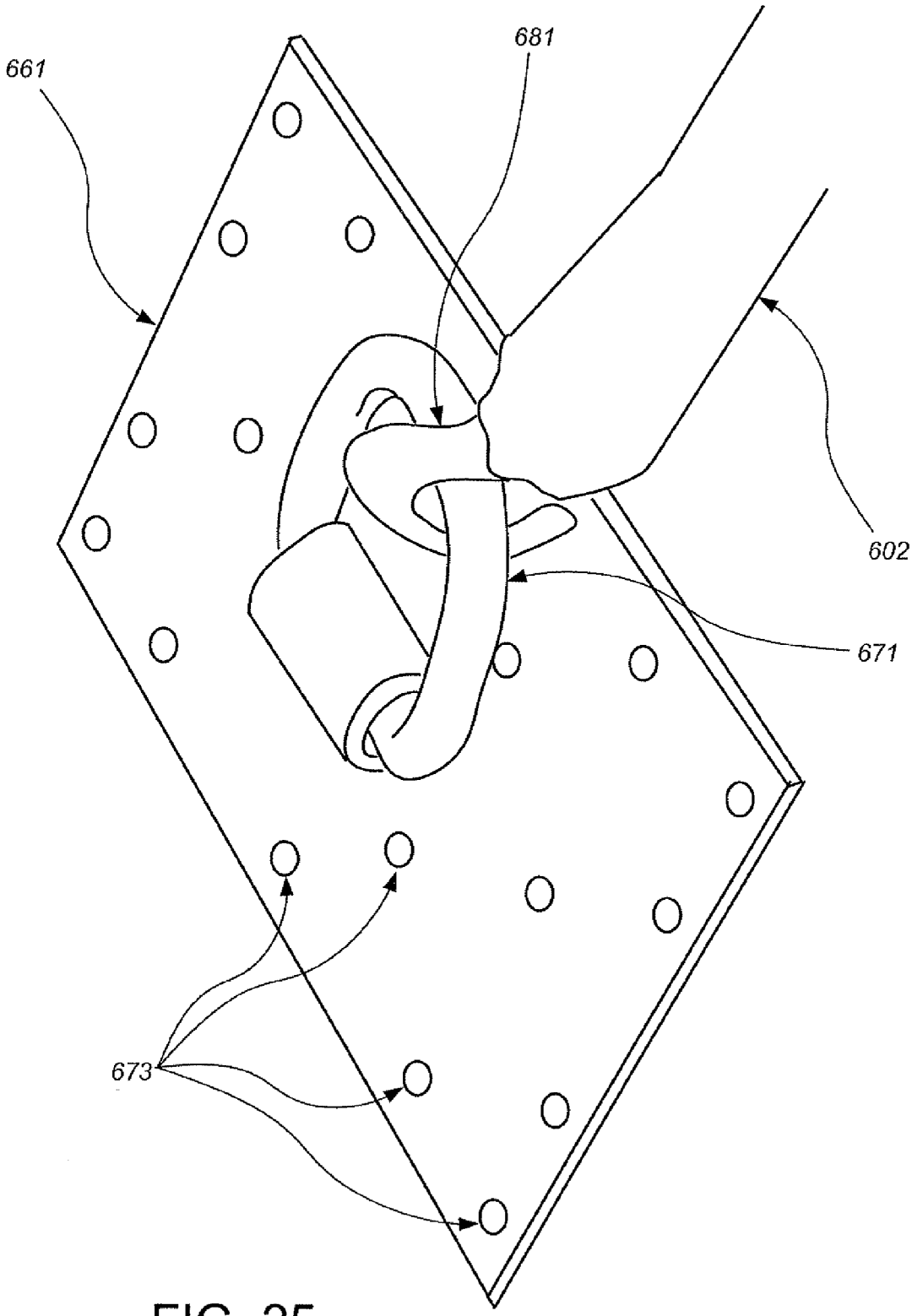
FIG. 25 depicts a close-up view of a D-plate comprised in a puller system according to another illustrative embodiment.

FIG. 25 depicts a close-up view of D-plate 661, including securely D-ring 671 and nail- or screw-holes 673. Strap 602 is engaged with D-plate 661 via hook 681. Fasteners such as nails or screws may be passed through any or all of holes 673 into a panel, to securely fasten D-plate 661 to the panel, as another alternative to means such as an endgrip such as described above. This embodiment may be particularly useful in applications where ensuring a securely fixed attachment of strap 602 to a panel is relatively difficult. For example, it is currently common to provide SIP panels measuring 28 feet (~6.7 meters) by eight feet (~2.44 meters), which each weigh approximately 700 pounds (~318 kilograms). Another, smaller size of 24 feet by four feet is also popular. In this application, D-plates may be more satisfactory than endgrips for ensuring the secure fixture of a strap to a panel while assembling the panels using a puller. Furthermore, these large SIP panels are typically manipulated by a crane, and the D-plate provides a single interface by which the SIP panels can be handled by a crane and be assembled using a puller.

Returning to FIG. 24, D-plate 661 may be used to anchor the far end of a strap at the opposite end of puller 601. As an additional option, a second D-plate 663 may also be used to help secure the puller 601 itself. A strap or other means may be used to anchor puller 601 to D-plate 663, which itself may be securely fastened to a component of the building structure that is already securely in place. Anchor tabs 651 and 653 may be used to secure a strap or other means between puller 601 and D-plate 663. Still other embodiments may used other means for secure attachment, such as adding toggle clamps that may be fastened to the corners of an SIP panel.

Figure 26:
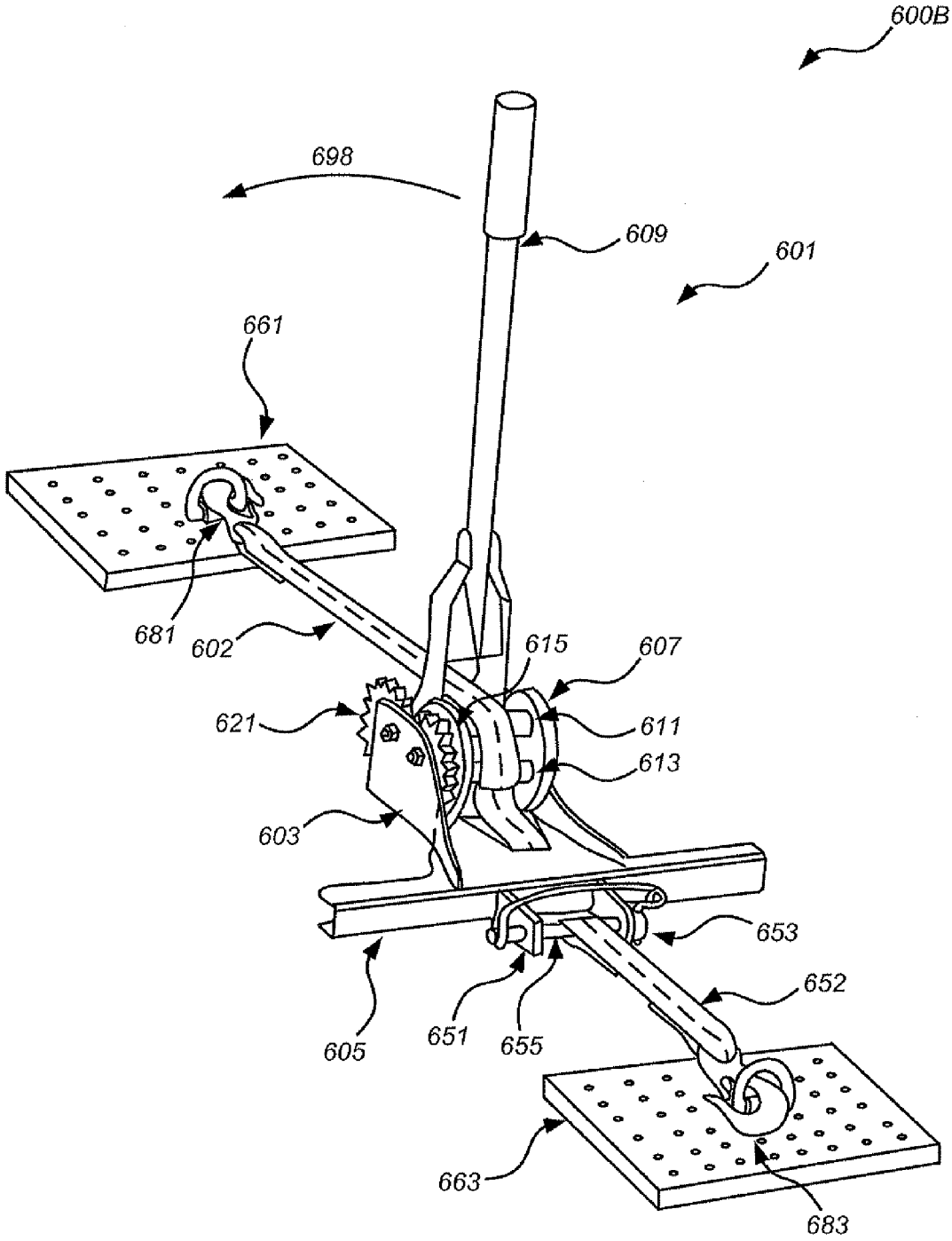
FIG. 26 depicts a puller system with puller and other associated components, according to another illustrative embodiment.

FIG. 26 depicts puller system 600B, as another embodiment of puller system 600 of FIG. 24, configured with associated components, according to this embodiment. Puller system 600B includes puller 601 with all the components described above. Puller system 600B also includes strap 602, hook 681, strap 652, hook 683, and snapper pin 655. Strap 602 is secured to the D-ring of D-plate 661 with hook 681 at one end, and threaded through rollers 611 and 613 of puller 601 at the other end. Snapper pin 655 is engaged between anchor tabs 651 and 653. Strap 652 is engaged about snapper pin 655 at one end, thereby securing strap 652 to puller body 603. Strap 652 is secured to D-plate 663 at the other end with a hook 683 engaged through the D-ring of D-plate 663. D-plate 663 may provide additional assurance of puller 601 remaining securely anchored to a base, such as an already assembled building portion, while D-plate 661 is securely fastened to a subject panel to be fitted into place, and lever 609 is rotated in direction 698 to exert tension on the subject panel to pull it into place.

Figure 27:
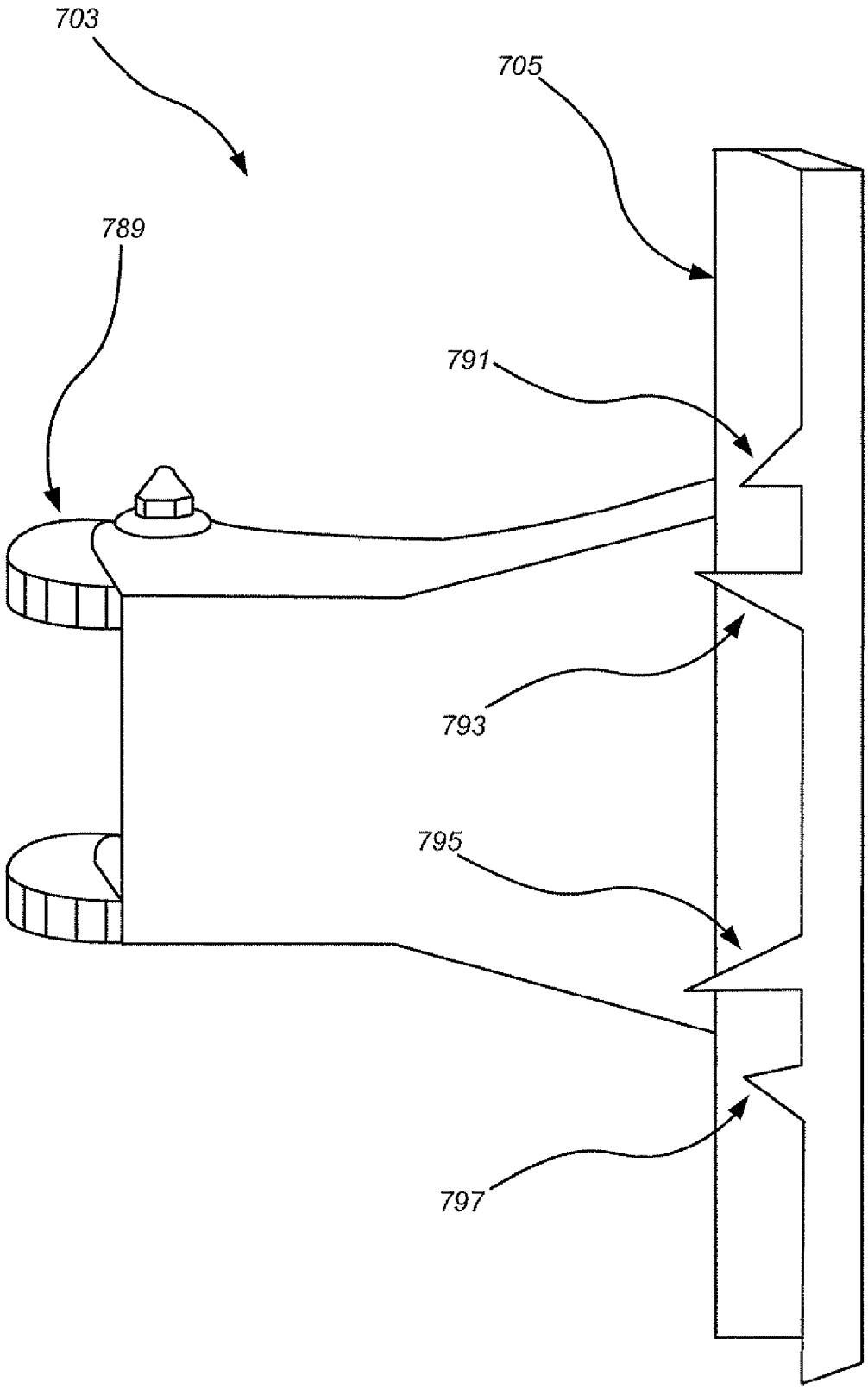
FIG. 27 depicts a component of a puller according to another illustrative embodiment.

FIG. 27 depicts another embodiment of a component of a puller. FIG. 27 depicts puller body 703 with integrated endgrip 705. Endgrip 705 includes several teeth 791, 793, 795, 797 for digging into the side of an SIP panel to help ensure a secure attachment, free of slippage, while the puller is being used to force a panel into place. Puller body 703 also has ratchet gearwheel 789 rotatably mounted to it. Ratchet gearwheel 789 may be interfaced by a pawl (not depicted in FIG. 26) to prevent a lever from rotating back in the direction opposite to the one desired during a pulling task, particularly when the application is specified to require more than one rotation of the lever.

Panel pullers according to various embodiments described herein provide dramatic advantages. For example, one user who was temporarily permitted to test a prototype of a panel puller according to one embodiment of the present subject matter, for the purpose of experimental testing, responded that despite building with SIP panels for twenty years, he had never thought of something like the prototype, and that it would have saved him so much time and effort over the years.

The panel puller not only fits SIP panels, but comes with various ends to fit any number of panel systems or other types of objects which are intended to be drawn toward each other and for which a levered, mechanically advantaged tension mechanism would be advantageous, in different embodiments.

The panel puller may be used in the installation of panels, and in other applications requiring a strap to be tightened or two elements to be drawn tightly together, or other utilization made of the panel puller. Although the present invention has been described with reference to preferred embodiments, workers skilled in the art will recognize that changes may be made in form and detail without departing from the spirit and scope of the invention.

What is claimed is:

1. A panel assembly system, comprising:
an anchor;
a tension line, secured to the anchor; and
a puller, wherein the puller comprises:
an engaging face;
a wheel, rotatably mounted to the engaging face, the wheel comprising a wheel gear;
a pivot joint, secured to the engaging face; and
a lever rotatably mounted about the pivot joint, the lever comprising a spur gear, the spur gear being engaged with the wheel gear, configured such that when the lever is rotated in one direction, the wheel rotates in the opposite direction;
wherein the puller is configured to receive the tension line threaded about the wheel, and to tense the tension line between the puller and the anchor, when the lever is rotated.

2. The panel assembly system of claim 1, wherein the wheel further comprises one or more rollers configured for the tension line to be wound around, such that segments of the tension line become frictionally engaged with each other when the lever is rotated.

3. The panel assembly system of claim 1, wherein the anchor comprises a hook.

4. The panel assembly system of claim 1, wherein the anchor comprises a plate with holes configured for receiving at least one of screws or nails.

5. The panel assembly system of claim 1, wherein the anchor comprises a D-ring.

6. The panel assembly system of claim 1, wherein the puller further comprises a hook endgrip.

7. The panel assembly system of claim 1, wherein the puller further comprises an L endgrip.

8. The panel assembly system of claim 1, wherein the puller further comprises a spline plate grip.

9. The panel assembly system of claim 1, wherein the puller is configured to be capable of being rotated over center with respect to the pivot joint.

10. The panel assembly system of claim 1, further comprising a ratchet system enabling the puller to be locked in place.

11. The panel assembly system of claim 1, wherein at least one of the puller and the anchor comprises at least one toggle clamp.

12. The panel assembly system of claim 1, wherein the spur gear has a smaller radius than the wheel gear.

13. The panel assembly system of claim 1, further comprising a roller mounted on the puller configured to reduce an angle between the tension line and a panel to which the puller and the anchor are mounted.

14. The panel assembly system of claim 1, wherein the puller further comprises one or more anchor tabs, configured for a tension line engagement with a second anchor.

15. The panel assembly system of claim 1, wherein the puller further comprises one or more teeth.

16. The panel assembly system of claim 1, wherein the wheel gear has a smaller radius than the spur gear.

17. A method of pulling subjects together, comprising the steps of:
securing an anchor with an art ached tension line to a first subject;
securing a puller with a rotatably mounted lever to a second subject, wherein the lever comprises a first roller and a second roller secured to the lever, the first roller at a greater radius along the lever from the pivot joint than the second roller;
threading the tension line around the first roller and the second roller; and
rotating the lever with segments of the tension line frictionally engaged with each other around at least one of the first roller and the second roller, thereby providing a tension force in the tension line between the puller and the anchor.

18. The method of claim 17, wherein the tension force is provided when the lever is rotated toward the anchor.

19. The method of claim 17, wherein the tension force is provided when the lever is rotated away from the anchor.

20. A puller, comprising:
an engaging face;
a pivot joint secured to the engaging face;
a lever rotatably mounted about the pivot joint; and
a first roller and a second roller secured to the lever, the first roller at a greater radius along the lever from the pivot joint than the second roller;
wherein the puller is configured to receive a tension line threaded around the first roller and the second roller, and to tense the tension line between the puller and an anchor to which the tension line is fastened, when the lever is rotated.

* * * * *